United States Patent [19]

Maldarelli

[11] 4,312,006

[45] Jan. 19, 1982

[54] METHODS AND APPARATUS FOR RECORDING INFORMATION SUPPLYING WOUND MATERIALS AND RETAINING TUBULAR OBJECTS

[75] Inventor: Lawrence V. Maldarelli, Tustin, Calif.

[73] Assignee: Bell & Howell Company, Chicago, Ill.

[21] Appl. No.: 925,498

[22] Filed: Jul. 17, 1978

[51] Int. Cl.[3] ..... G01D 15/28

[52] U.S. Cl. ..... 346/136; 242/68.4; 242/74; 242/75.45; 346/108

[58] Field of Search ..... 346/108, 109, 110, 136; 242/74, 68.4, 73, 75.45

[56] References Cited

U.S. PATENT DOCUMENTS

| | | | |
|---|---|---|---|
| 1,199,246 | 9/1916 | Clark | 242/74 |
| 1,531,705 | 3/1925 | Little . | |
| 1,676,797 | 7/1928 | Nyman | 242/75.45 |
| 1,693,876 | 12/1928 | Unruh . | |
| 1,702,971 | 2/1929 | Jeffress . | |
| 2,031,635 | 2/1936 | De Vry | 242/74 X |
| 2,055,626 | 9/1936 | Howell | 242/71.8 |
| 2,592,595 | 4/1952 | Patterson | 242/75.45 X |
| 2,618,528 | 11/1952 | Caldwell | 346/136 |
| 2,627,103 | 2/1953 | Jennings | 242/75.45 X |
| 2,771,251 | 11/1956 | Silverstein | 242/68.4 |
| 2,917,251 | 12/1959 | Newburger | 242/74 |
| 2,963,236 | 12/1960 | Grosser | 242/75.45 |
| 3,051,287 | 8/1962 | Grafton | 242/75.45 X |
| 3,087,593 | 4/1963 | Kloski | 242/74 X |
| 3,104,073 | 9/1963 | Post | 242/67.2 |
| 3,155,336 | 11/1964 | Uterhart | 242/74 X |
| 3,216,021 | 11/1965 | Stefansson | 346/136 |
| 3,360,210 | 12/1967 | Frisbie | 242/65 |
| 3,363,256 | 1/1968 | Evans | 346/136 X |
| 3,497,152 | 2/1970 | Ivaldi | 242/67.3 |
| 3,539,126 | 11/1970 | Meserue . | |
| 3,720,385 | 3/1973 | Staats | 242/75.45 |
| 3,792,825 | 2/1974 | Kampf | 346/136 X |
| 3,941,320 | 2/1976 | Strunr | 242/68.4 X |
| 3,955,770 | 5/1976 | Offermann | 242/68.4 |

FOREIGN PATENT DOCUMENTS

| | | | |
|---|---|---|---|
| 583958 | 8/1933 | Fed. Rep. of Germany | 242/74 |

*Primary Examiner*—Joseph W. Hartary
*Attorney, Agent, or Firm*—Benoit Law Corporation

[57] ABSTRACT

The subject information recording methods and apparatus are capable of handling either a recording medium strip wound on a supply roll with the information recording surface layer facing inwardly, or a recording medium strip wound on a supply roll with the information recording surface layer facing outwardly. In particular, a drive roller is mounted at a recording station and the recording medium strip is run from the particular supply roll about part of the drive roller with the information recording surface layer facing away from the drive roller at the recording station irrespective of the direction in which the recording surface layer faces on the supply roll. The drive roller is rotated at the recording station and the recording medium strip is driven from the supply roll through the recording station. Information is recorded on successive portions of the recording medium strip while each of these portions is located on the drive roller with its information recording surface layer facing away from the drive roller. The recording medium strip is either wound into a takeup roll or discharged from the recording apparatus.

Methods and apparatus for supplying wound material from a roll of diminishing diameter, and methods and apparatus for releasably retaining any one of several tubular objects of different lengths are also disclosed.

66 Claims, 14 Drawing Figures

17
23
2
2
24
OSCILLOGRAPH PRINTOUT
OR FACSIMILE APPARATUS
12
13
10
123
124
125
26
25
15
27
28
29
81
86
87
80
89'
47
83
89
46
48
85
80
92
42
92'
128
82
82'
84

METHODS AND APPARATUS FOR RECORDING INFORMATION SUPPLYING WOUND MATERIALS AND RETAINING TUBULAR OBJECTS

BACKGROUND OF THE INVENTION

1. Field of the Invention

The subject invention relates to oscillography and oscillographs and other recording methods and recorders, to methods and apparatus for supplying wound material from rolls of diminishing diameter and other winding and reeling methods and apparatus, to methods and apparatus for releasably retaining any one of several tubular objects of different lengths, and to combinations of such methods and apparatus.

2. Description of the Prior Art

An advanced type of record medium transport mechanism is disclosed in U.S. Pat. No. 3,216,021. That apparatus appears able to handle reporting medium strips wound on a supply roll and having an information recording surface layer either facing inwardly or outwardly on the supply roll. Also, that apparatus appears capable of winding the recording medium strip, after recordation thereon, on a takeup roller, or then of discharging such recording medium strip from the machine. To this end, that prior-art apparatus has a drive roller with gearing shiftable between different positions, as well as a shiftable front door with roller mount bearings and shiftable takeup roller.

This tends to introduce complexities and limitations in practice. Also, the supply roll in that type of apparatus may unwind too quickly or non-uniformly as a function of diminishing supply roll diameter.

Also, that type of apparatus requires the recording material to be disposed on core with laterally projecting shafts on the supply and takeup sides.

U.S. Pat. Nos. 1,531,705, 3,360,210, 3,497,152 and 3,539,126 propose various winding devices and similar apparatus in which rolls are geared together or mutually engaged to rotate in unison. In practice, such systems often are difficult to realize or are subject to design limitations.

In the prior-art equipment under consideration, there also exists a need for more convenient and effective supply roll mounting systems for accommodating supply rolls located on tubular supports of different lengths.

In more general terms, there exists a need for methods and apparatus for releasably retaining any one of several tubular objects of different lengths.

In this respect, an early proposal according to U.S. Pat. No. 1,683,876 employs conical cable drum retaining members which are rotatably mounted on a pair of spaced standards. In practice, there existed the drawback that at least an entire standard had to be moved to accommodate cable drums of different widths. To somewhat alleviate this problem, the proposal according to U.S. Pat. No. 3,955,770 mounts the coil-supporting assemblies on tracks for sliding movement toward and away from each other. The proposal according to U.S. Pat. No. 1,702,971 employs flat paddles for supporting bolts of cloth preparatory to and during unwinding operations. One of the paddles is rotatably mounted on a standard which, together with a tubular track extending parallel to an axis through the paddles, is attached to the floor. The other paddle is rotatably mounted on a standard which, in turn, is supported on a tubular carriage riding in the mentioned tubular track. A spring has opposite ends attached to, and extends through the tubular track and carriage; biasing the carriage into the tubular track. A locking device arrests the motion of the carriage relative to the tubular track at any one of several incremental positions in order to permit an accommodation of bolts of cloth of different widths. In so arresting the motion of the carriage, the locking device also renders the mentioned spring ineffective from exercising a biasing function on the cloth retaining paddles.

In practice, the latter drawback coupled with an only step-wise adjustability of the distance between the paddles would render that prior-art system unsuitable for releasably retaining tubular members or supply rolls of different lengths.

An infinitely adjustable spacing between supply roll retention members appears possible in the system disclosed in U.S. Pat. No. 3,104,073. However, the use of a tool and the carrying out of set screw releasing and tightening operations are then required for each change in supply roll width.

A later proposal according to U.S. Pat. No. 3,941,320 appears only suitable for clamping tubular supply roll supports of a given length.

A proposal according to U.S. Pat. No. 3,792,825 uses spring clamps acting on the outside of a supply roll for retaining same in a chart drive system. That principle appears to be rather limited to the handling of perforated paper rolls. The latter patent also proposes the use of pads as braking devices. Again, there appears to be a design limitation to particular chart roll materials.

A more universally applicable tension regulator has been proposed in U.S. Pat. No. 1,676,797 wherein a roller rests on the outside of the supply roll to sense its diminishing diameter during unwinding of the material from the supply roll. That sensing roller is rotatably mounted in an arm which is spring biased to maintain the sensing roller in contact with the supply roll. That arm also transmits the motion of the sensing roller along a circular trajectory through the axis of rotation of the supply roll to a friction head or button that rides on a circular friction surface rotating with the supply roll.

The subsequent U.S. Pat. No. 3,720,385 alludes to drawbacks in the latter prior-art tensioning system and, in turn, proposes to do away with the need for a spring bias of the roll diameter sensor by placing cylindrical sensing means as well as corresponding brake means at loci beyond points of tangency between a circle of a diameter of the effective braking disk diameter and a tanential line passing through the pivot point of follower arms to which the sensing and braking means are attached.

In practice, the latter proposal, in turn, has the drawback of operating only in one sense of rotation of the supply roll. This is a particular disadvantage if supply rolls containing a recording material having an information recording surface layer facing inwardly and supply rolls containing a recording medium having a recording surface layer facing outwardly are to be employed alternatively in the particular system. Moreover, the sensing rolls or cylindrical members of prior-art tension regulators often have eventuated the formation of bumps or other warped conditions in the supply roll.

SUMMARY OF THE INVENTION

It is a general object of this invention to alleviate or avoid the above mentioned disadvantages and to satisfy the above mentioned needs.

It is a germane object of this invention to provide improved methods and apparatus for releasably retaining any one of several tubular objects of different lengths.

It is also an object of this invention to provide improved methods and apparatus for supplying wound material from a roll of diminishing diameter at bidirectionally controlled tension.

It is a related object of this invention to provide improved methods and apparatus for supplying wound material from a roll of diminishing diameter located on a tubular support.

It is also an object of this invention to provide improved methods and apparatus for recording information.

It is a related object of this invention to provide improved methods of oscillography and oscillograph apparatus.

It is also an object of this invention to provide novel combinations of features leading to improved oscillography and oscillographs or other information recording systems; including combinations of methods or apparatus for supplying wound material from a roll of diminishing diameter located on a tubular support with methods and apparatus for releasably retaining any one of several tubular objects of different lengths.

A related object of this invention concerns the provision of improved oscillography and oscillographs or other information recording systems by combining the latter combination with a system for bidirectionally controlling the tension of the material unwinding from a supply roll.

It is a related object of this invention to provide improved recording medium or master record transports and transporting methods for oscillography, facsimili and printout systems.

It is a specific object of this invention to provide improved paper, recording medium and master record transports for the oscilloraphy, facsimili, printout and other equipment disclosed in copending United States Patent Application Ser. No. 776,157, filed Mar. 10, 1977, by John H. Jacobs, now abandoned for Light Gate Utilization Methods and Apparatus, assigned to the subject assignee and herewith incorporated by reference herein.

Other objects of this invention will become apparent in the further course of this disclosure.

From a first aspect thereof, the subject invention resides in a method of releasably retaining any one of several tubular objects of different lengths between a pair of mutually adjustable retention members, with the aid of a carriage movable relative to one of said retention members, a locking member, and a spring. More specifically, the invention according to this aspect resides in the improvement comprising in combination the steps of positioning said spring against said locking member, mounting the other of said retention members on said carriage, rendering said locking member movable along with said carriage and said carriage movable relative to said locking member, placing the retention members against opposite ends of any one of said tubular objects by moving the carriage and the locking member toward said one retention member, arresting said, locking member against movement away from said one retention member, moving said carriage and said other retention member toward said one retention member after said arrestation of the locking member, until said retention member comes to a stop against said one tubular object, and resiliently biasing one of said retention members against said one tubular object and said one tubular object against the other retention member by compression of said spring against said locking member.

According to another aspect thereof, the subject invention resides in a method of releasably retaining any one of several tubular objects of different lengths between a pair of mutually spaced retention members, with the aid of a carriage movable relative to one of said retention members, and a locking member. The invention according to this aspect resides, more specifically, in the improvement comprising in combination the steps of mounting the other of said retention members on said carriage, rendering said locking member movable along with said carriage and said carriage movable relative to said locking member, placing any one of said tubular objects in the space between said retention members, moving said carriage and locking member toward said one retention members to adjust the spacing between said retention members to the length of said placed tubular member, arresting said locking member against movement away from said one retention member, and clamping said placed tubular member between said retention members by moving said carriage relative to said arrested locking member toward said one retention member.

According to another aspect thereof, the subject invention resides in a method of supplying wound material from a roll of diminishing diameter located on a tubular support, with the aid of a pair of mutually adjustable retention members, with the aid of a carriage movable relative to one of said retention members, a locking member, and a spring. The invention according to this aspect resides, more specifically, in the improvement comprising in combination the steps of positioning said spring against said locking member, mounting the other of said retention members on said carriage, rendering said locking member movable along with said carriage and said carriage movable relative to said locking member, placing said retention members against opposite ends of said tubular support by moving the carriage and the locking member toward said one retention member, arresting said, locking member against movement away from said one retention member, moving said carriage and said other retention member toward said one retention member after said arrestation of the locking member, until said retention member comes to a stop against aid one tubular object, resiliently biasing one of said retention members against said tubular support and said tubular support against the other retention member by compression of said spring against said locking member, providing a pair of friction surfaces, generating friction at a location on one of said surfaces, rotating said one surface about an axis perpendicularly intersecting said one surface at a distance from said location and generating at said location, at least during some rotations of said one surface, a force tending to move said location toward said intersection of said axis with said one surface, transmitting said force to the other of said friction surfaces and applying said other friction surface to said roll, moving said location of friction toward said intersection along a trajectory intersecting said axis, and maintaining said other surface in frictional engagement with said roll, as the diameter of said roll diminishes, and coupling a said retention member to said rotating one surface for rotation therewith.

According to another aspect thereof, the subject invention resides in a method of supplying would material from a roll of diminishing diameter located on a tubular support, with the aid of a pair of mutually spaced retention members, a carriage movable relative to one of said retention members, and a locking member. The invention according to this aspect resides, more specifically, in the improvement comprising in combination the steps of mounting the other of said retention members on said carriage, rendering said locking member movable along with said carriage and said carriage movable relative to said locking member, placing said tubular support in the space between said retention members, moving said carriage and locking member toward said one retention member to adjust the spacing between said retention members to the length of said placed tubular support, arresting said locking member against movement away from said one retention member, clamping said placed tubular support between said retention members by moving said carriage relative to said arrested locking member toward said one retention member, providing a pair of friction surfaces, generating friction at a location on one of said surfaces, rotating said one surface about an axis perpendicularly intersecting said one surface at a distance from said location, and generating at said location, at least during some rotations of said one surface, a force tending to move said location toward said intersection of said axis with said one surface, coupling a said retention member to said rotating one surface for rotation therewith, transmitting said force to the other of said friction surfaces and applying said other friction surface to said roll, moving said location of friction toward said intersection along a trajectory intersecing said axis, and maintaining said other surface in frictional engagement with said roll, as the diameter of said roll diminishes.

According to another aspect thereof, the subject invention resides in a method of recording information, with the aid of a recording station and a drive roller, on a recording medium strip wound on a supply roll and having an information recording surface layer selectively facing inwardly and outwardly on said supply roll. The invention according to this aspect resides, more specifically, in the improvement comprising in combination the steps of providing a pair of mutually adjustable supply roll retention members, providing a pair of friction surfaces, mounting said retention members for rotation about a common axis at said recording station for rotatably mounting said supply roll at said recording station, coupling one of said friction surfaces to a said retention member for rotation therewith, placing said retention members against opposite ends of said supply roll, locking said placed retention members against movement away from each other, resiliently biasing one of said retention members against said supply roll and said supply roll against the other retention member, generating friction at a location on said one surface, running said recording medium strip from said supply roll about part of said drive roller with said information recording surface layer facing away from said drive roller at said recording station irrespective of the direction in which said recording surface layer faces on said supply roll, rotating said drive roller at said recording station and driving said recording medium strip with said rotating drive roller from said supply roll through said recording station, rotating said one surface about an axis perpendicularly intersecting said one surface at a distance from said location and generating at said location, at least during some rotations of said one surface, a force tending to move said location toward said intersection of said axis with said one surface, transmitting said force to the other of said friction surfaces and applying said other friction surface to said roll, moving said location of friction toward said intersection along a trajectory intersecting said axis, and maintaining said other surface in frictional engagement with said roll, as the diameter of said roll diminishes, thereby enabling a recording medium strip braking operation in either sense of rotation of said retention members, recording information on successive portions of said recording medium strip while each of said portions is located on said drive roller with its information recording surface layer facing away from said drive roller, and discharging said recording medium strip from said recording station.

According to another aspect thereof, the subject invention resides in a method of recording information, with the aid of a recording station, a drive roller and a takeup roller, on a recording medium strip wound on a supply roll and having an information recording surface layer selectively facing inwardly and outwardly on said supply roll. The invention according to this aspect resides, more specifically, in the improvement comprising in combination the steps of providing a pair of mutually adjustable supply roll retention members, providing a pair of friction surfaces, mounting said retention members for rotation about a common axis at said recording station for rotatably mounting said supply roll at said recording station, coupling one of said friction surfaces to a said retention member for rotation therewith, placing said retention members against opposite ends of said supply roll, locking said placed retention members against movement away from each other, resiliently biasing one of said retention members against said supply roll and said supply roll against the other retention member, rotatably mounting said takeup roller at a location spaced from said drive roller, generating friction at a location on said one surface, running said recording medium strip from said supply roll about part of said drive roller to said takeup roller, with said information recording surface layer facing away from said drive roller at said recording station irrespective of the direction in which said recording surface layer faces on said supply roll, rotating said one surface about an axis perpendicularly intersecting said one surface at a distance from said location and generating at said location, at least during some rotations of said one surface, a force tending to move said location toward said intersection of said axis with said one surface, transmitting said force to the other of said friction surfaces and applying said other friction surface to said roll, moving said location of friction toward said intersection along a trajectory intersecting said axis, and maintaining said other surface in frictional engagement with said roll, as the diameter of said roll diminishes, thereby enabling a recording medium strip braking operation in either sense of rotation of said retention members, rotating said drive roller at said recording station and said takeup roller at said spaced location and driving said recording medium strip with said rotating drive and takeup rollers from said supply roll through said recording station to said takeup roller and winding said recording medium on said takeup roller with said rotating takeup roller, and recording information on successive portions of said recording medium strip while each of said portions is located on said drive roller with its information recording surface layer facing away from said drive roller.

According to another aspect thereof, the subject invention resides in a method of supplying wound material from a roll of diminishing diameter in either sense of rotation of the roll at bidirectionally controlled tension. The invention according to this aspect resides, more specifically, in the improvement comprising in combination the steps of providing a pair of friction surfaces, generating friction at a location on one of said surfaces, rotating said one surface about an axis perpendicularly intersecting said one surface at a distance from said location and generating at said location, at least during some rotations of said one surface, a force tending to move said location toward said intersection of said axis with said one surface, transmitting said force to the other of said friction surfaces and applying said other friction surface to said roll, moving said location of friction toward said intersection along a trajectory intersecting said axis, and maintaining said other surface in frictional engagement with said roll, as the diameter of said roll diminishes, thereby enabling operation in either sense of ro- of said roll.

According to another aspect thereof, the subject invention resides in a method of recording information, with the aid of a recording station and a drive roller, on a recording medium strip wound on a supply roll and having an information recording surface layer selectively facing inwardly and outwardly on said supply roll. The invention according to this aspect resides, more specifically, in the improvement comprising in combination the steps of rotatably mounting said drive roller at said recording station, running said recording medium strip from said supply roll about part of said drive roller with said information recording surface layer facing away from said drive roller at said recording station irrespective of the direction in which said recording surface layer faces on said supply roll, rotating said drive roller at said recording station and driving said recording medium strip with said rotating drive roller from said supply roll through said recording station, recording information on successive portions of said recording medium strip while each of said portions is located on said drive roller with its information recording surface layer facing away from said drive roller, and discharging said recording medium strip from said recording station.

According to another aspect thereof, the subject invention resides in a method of recording information, with the aid of a recording station, a drive roller and a takeup roller, on a recording medium strip wound on a supply roll and having an information recording surface layer selectively facing inwardly and outwardly on said supply roll. The invention according to this aspect resides, more specifically, in the improvement comprising in combination the steps of rotatably mounting said drive roller at said recording station, rotatably mounting said takeup roller at a location spaced from said drive roller, running said recording medium strip from said supply roll about part of said drive roller to said takeup roller, with said information recording surface layer facing away from said drive roller at said recording station irrespective of the direction in which said recording surface layer faces on said supply roll, rotating said drive roller at said recording station and said takeup roller at said spaced location and driving said recording medium strip with said rotating drive and takeup rollers from said supply roll through said recording station to said takeup roller and winding said recording medium on said takeup roller with said rotating takeup roller, and recording information on successive portions of said recording medium strip while each of said portions is located on said drive roller with its information recording surface layer facing away from said drive roller.

According to another aspect thereof, the subject invention resides in an apparatus for releasably retaining any one of several tubular objects of different lengths, comprising, in combination, a pair of mutually adjustable retention members, means coupled to said retention members and including a carriage riding on said rail means for placing said retention members against opposite ends of any one of said tubular objects, means connected to said placing means for locking said placed retention members against movement away from each other, including locking means movable along said rail means, means coupled to said locking means for selectively arresting said locking means relative to said rail means, means coupled to said carriage and locking means for moving said carriage relative to said arrested locking means, and means for resiliently biasing one of said retention member against said one tubular object and said one tubular object against the other retention member, including a spring and a linkage member coupled to said carriage and said spring for compressing said spring against said arrested locking member.

According to another aspect thereof, the subject invention resides in an apparatus for releasably retaining any one of several tubular objects of different lenghts, comprising, in combination, a pair of mutually spaced retention members for receiving any one of said tubular objects therebetween, rail means extending parallel to an axis through said retention members, means for mounting one of said retention members relative to the other retention member, including a carriage movable along said rail means relative to said other retention member, and means for mounting said one retention member on said carriage, for an adjustable of the spacing between said retention members to the length of any selected one of said tubular objects, locking means movable along said rail means, means coupled to said locking means for selectively arresting said locking means against movement away from said other retention member, and means coupled to said carriage and locking means for moving said carriage relative to said arrested locking means toward said other retention member for clamping said selected tubular object between said retention members.

According to another aspect thereof, the subject invention resides in apparatus for supplying wound material from a roll of diminishing diameter located on a tubular support. The invention according to this aspect resides, more specifically, in the improvement comprising, in combination, a pair of mutually adjustable retention members for retaining opposite ends of said tubular support, rail means extending parallel to an axis through said retention members, a carriage riding on said rail means and mounting one of said retention members, means for selectively locking said retention members against movement away from each other, including locking means movable along said rail means, means coupled to said locking means for selectively arresting said locking means relative to said rail means, coupled to said carriage and locking means for moving said carriage relative to said arrested locking means, means for resiliently biasing said one retention member against said tubular support and said tubular support against the other retention member, including a spring and a linkage member coupled to said carriage and said spring for compressing said spring against said arrested locking member, a pair of friction surfaces, means for generating friction on one of said surfaces, means coupled to said one surface for rotating said one surface about an axis perpendicularly intersecting said one surface at a distance from said friction generating means, means coupled to said friction generating means for generating at said friction generating means, at least during some rotations of said one surface, a force tending to move said friction generating means toward said intersection of said axis with said one surface, means coupled to said friction generating means and the other of said friction surfaces for transmitting said force to said other friction surface and applying said other friction surface to said roll, means coupled to said friction generating means for moving said friction generating means toward said intersection along a trajectory intersecting said axis and for maintaining said other surface in frictional engagement with said roll, as the diameter of said roll diminishes, and means coupled to said one friction surface for coupling a said retention member to said one surface for rotation therewith.

According to another aspect thereof, the subject invention resides in an apparatus for supplying wound material from a roll of diminishing diameter located on a tubular support, comprising, in combination, a pair of mutually spaced retention members for receiving said tubular support therebetween, rail means extending parallel to an axis through said retention members, means for mounting one of said retention members relative to the other retention member, including a carriage movable along said rail means relative to said other retention member, and means for mounting said one retention member on said carriage, for an adjustment of the spacing between said retention members to the length of said tubular support, locking means movable along said rail means, means coupled to said locking means for selectively arresting said locking means against movement away from said other retention member, means coupled to said carriage and locking means for moving said carriage relative to said arresting locking means toward said other retention member for clamping said tubular support between said retention members, a pair of friction surfaces, means for generating friction on one of said surfaces, means coupled to said one surface for rotating said one surface about an axis perpendicularly intersecting said one surface at a distance from said friction generating means, means coupled to said friction generating means for generating at said friction generating means, at least during some rotations of said one surface, a force tending to move said friction generating means toward said intersection of said axis with said one surface, means for coupling a said retention member to said rotating one surface for rotation therewith, means coupled to said friction generating means and the other of said friction surfaces for transmitting said force to said other friction surface and applying said other friction surface to said roll, means coupled to said friction generating means for moving said friction generating means toward said intersection along a trajectory intersecting said axis and for maintaining said other surface in frictional engagement with said roll, as the diameter of said roll diminishes.

According to another aspect thereof, the subject invention resides in apparatus for recording information at a recording station on a recording medium strip wound on a supply roll and having an information recording surface layer selectively facing inwardly and outwardly on said supply roll. The invention according to this aspect resides, more specifically, in the improvement comprising, in combination, a pair of mutually adjustable supply roll retention members, means for mounting said retention members for rotation about a common axis at said recording station for rotatably mounting said supply roll at said recording station, means coupled to said retention members for placing said retention members against opposite ends of said supply roll, means coupled to said placing means for locking said placed retention members against movement away from each other, means coupled to said locking means for resiliently biasing one of said retention members against said supply roll and said supply roll against the other retention member, a drive roller, means for mounting said drive roller at said recording station, means for running said recording medium strip from said supply roll about part of said drive roller with said information recording surface layer facing away from said drive roller at said recording station irrespective of the direction in which said recording surface layer faces on said supply roll, means coupled to said drive roller for rotating said drive roller at said recording station and for driving said recording medium strip with said rotating drive roller from said supply roll through said recording station, means for recording information on successive portions of said recording medium strip while each of said portions is located on said drive roller with its information recording surface layer facing away from said drive roller, means for discharging said recording medium strip from said recording station, a pair of friction surfaces, means for generating friction on one of said surfaces, means for coupling said one friction surface to a said retention member for rotation therewith about an axis perpendicularly intersecting said one surface at a distance from said friction generating means, means coupled to said friction generating means for generating, at least during some rotations of said one surface, a force tending to move said friction generating means toward said intersection of said axis with said one surface, thereby enabling a recording medium strip braking operation in either sense of rotation of said retention members, means coupled to said friction generating means and the other of said friction surface for transmitting said force to said other friction surface and applying said other friction surface to said roll, and means coupled to said friction generating means for moving said friction generating means toward said intersection along a trajectory intersecting said axis and for maintaining said other surface in frictional engagement with said roll, as the diameter of said roll diminishes.

According to another aspect thereof, the subject invention resides in apparatus for recording information at a recording station on a recording medium strip wound on a supply roll and having an information recording surface layer selectively facing inwardly and outwardly on said supply roll. The invention according to this aspect resides, more specifically, in the improvement comprising, in combination, a pair of mutually adjustable supply roll retention members, means for mounting said retention members for rotation about a common axis at said recording station for rotatably mounting said supply roll at said recording station, means coupled to said retention members for placing said retention members against opposite ends of said supply roll, means coupled to said placing means for locking said placed retention members against movement away from each other, means coupled to said locking means for resiliently biasing one of said retention members against said supply roll and said supply roll against the other retention member, a drive roller, means for mounting said drive roller at said recording station, a takeup roller rotatably mounted at a location spaced from said drive roller, means for running said recording medium strip from said supply roll about part of said drive roller to said takeup roller, with said information recording surface layer facing away from said drive roller at said recording station irrespective of the direction in which said recording surface layer faces on said supply roll, means coupled to said drive roller and said takeup roller for rotating said drive roller at said recording station and said takeup roller at said spaced location and driving said recording medium strip with said rotating drive and takeup rollers from said supply roll through said recording station to said takeup roller and winding said recording medium on said takeup roller with said rotating takeup roller, means for recording information on successive portions of said recording medium strip while each of said portions is located on said drive roller with its information recording surface layer facing away from said drive roller, a pair of friction surfaces, means for generating friction on one of said surfaces, means for coupling said one friction surface to a said retention member for rotation therewith about an axis perpendicularly intersecting said one surface at a distance from said friction generating means, means coupled to said friction generating means for generating, at least during some rotations of said one surface, a force tending to move said friction generating means toward said intersection of said axis with said one surface, thereby enabling a recording medium strip braking operation in either sense of rotation of said retention members, means coupled to said friction generating means and the other of said friction surfaces for transmitting said force to said other friction surface and applying said other friction surface to said roll, and means coupled to said friction generating means for moving said friction generating means toward said intersection along a trajectory intersecting said axis and for maintaining said other surface in frictional engagement with said roll, as the diameter of said roll diminishes According to another aspect thereof, the subject invention resides in apparatus for supplying wound material from a roll of diminishing diameter in either sense of rotation of the roll at bidirectionally controlled tension. The invention according to this aspect resides, more specifically, in the improvement comprising, in combination, a pair of friction surfaces, means for generating friction on one of said surfaces, means for rotating said one surface about an axis perpendicularly intersecting said one surface at a distance from said friction generating means, means coupled to said friction generating means for generating, at least during some rotations of said one surface, a force tending to move said friction generating means toward said intersection of said axis with said one surface, means coupled to said friction generating means and the other of said friction surface for transmitting said force to said other friction surface and applying said other friction surface to said roll, means coupled to said friction generating means for moving said friction generating means toward said intersection along a trajectory intersecting said axis and for maintaining said other surface in frictional engagement with said roll, as the diameter of said roll diminishes, thereby enabling operation in either sense of rotation of said roll.

According to another aspect thereof, the subject invention resides in apparatus for recording information at a recording station on a recording medium strip wound on a supply roll and having an information recording surface layer selectively facing inwardly and outwardly on said supply roll. The invention according to this aspect resides, more specifically, in the improvement comprising, in combination, means for rotatably mounting said drive roller at said recording station, means for running said recording medium strip from said supply roll about part of said drive roller with said information recording surface layer facing away from said drive roller at said recording station irrespective of the direction in which said recording surface layer faces on said supply roll, means coupled to said drive roller for rotating said drive roller at said recording station and for driving said recording medium strip with said rotating drive roller from said supply roll through said recording station, means for recording information on successive portions of said recording medium strip while each of said portions is located on said drive roller with its information recording surface layer facing away from said drive roller, and means for discharging said recording medium strip from said recording station.

According to another aspect thereof, the subject invention resides in apparatus for recording information at a recording station on a recording medium strip wound on a supply roll and having an information recording surface layer selectively facing inwardly and outwardly on said supply roll. The invention according to this aspect resides, more specifically, in the improvement comprising, in combination, means for rotatably mounting said drive roller at said recording station, means for rotatably mounting said takeup roller at a location spaced from said drive roller, means for running said recording medium strip from said supply roll about part of said drive roller to said takeup roller, with said information recording surface layer facing away from said drive roller at said recording station irrespective of the direction in which said recording surface layer faces on said supply roll, means coupled to said drive and takeup rollers for rotating said drive roller at said recording station and said takeup roller at said spaced location and for driving said recording medium strip with said rotating drive and takeup rollers from said supply roll through said recording station to said takeup roller and for winding said recording medium on said takeup roller with said rotating takeup roller, and means for recording information on successive portions of said recording medium strip while each of said portions is located on said drive roller with its information recording surface layer facing away from said drive roller.

According to another aspect thereof, the subject invention resides in a method of attaching a sheet of pierceable material having opposite major surface and a free end to a roller having an outer cylindrical surface. The invention according to this aspect resides, more specifically, in the improvement comprising in combination the steps of providing an opening through the cylindrical surface into the roller and defining part of such opening with a plurality of sharp teeth at the cylindrical surface, and applying one of said major surfaces of the sheet to the roller at said opening and at a distance from said free end and piercing the sheet with the teeth by applying a finger to the other of said major surfaces of the sheet and depressing a portion of the sheet at said opening with the applied finger into said opening at said distance from the free end to attach the sheet to the roller.

According to another aspect thereof, the subject invention resides in a method of winding a sheet of pierceable material having opposite major surfaces and a free end onto a tubular roller having a hollow-cylindrical wall. The invention according to this aspect resides, more specifically, in the improvement comprising in combination the steps of providing an opening through the hollow-cylindrical wall and defining part of such opening with a plurality of sharp teeth formed of portions of the hollow-cylindrical wall, applying one of said major surfaces of the sheet to the hollow-cylindrical wall at the opening and at a distance from said free end and piercing the sheet with the teeth by applying a finger to the other of said major surfaces of the sheet and depressing a portion of the sheet at said opening with the applied finger into said opening at said distance from the free end to attach the sheet to the roller, and rotating the roller having the sheet attached thereto for winding the sheet onto the roller.

According to another aspect thereof, the subject invention resides in apparatus for winding a sheet of pierceable material having opposite major surfaces and a free end. The invention according to this aspect resides, more specifically, in the improvement comprising, in combination, a roller having an outer cylindrical surface, an opening through the cylindrical surface and into the roller for receiving a portion of the sheet at one of the major surfaces at a distance from the free end, means for attaching the sheet to the roller including sets of pluralities of sharp teeth facing each other across the opening at the cylindrical surface, such opening extending for an unobstructed free path from one set of the teeth to an opposite set of the teeth for receiving the sheet in piercing engagement with the sets of teeth at the one major surface and being open at all times until closed by application of the sheet to the roller at the opening, and means coupled to the roller for rotating the roller about an axis of rotation whereby to wind the attached sheet onto the roller.

BRIEF DESCRIPTION OF THE DRAWINGS

The subject invention and its various objects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1A:
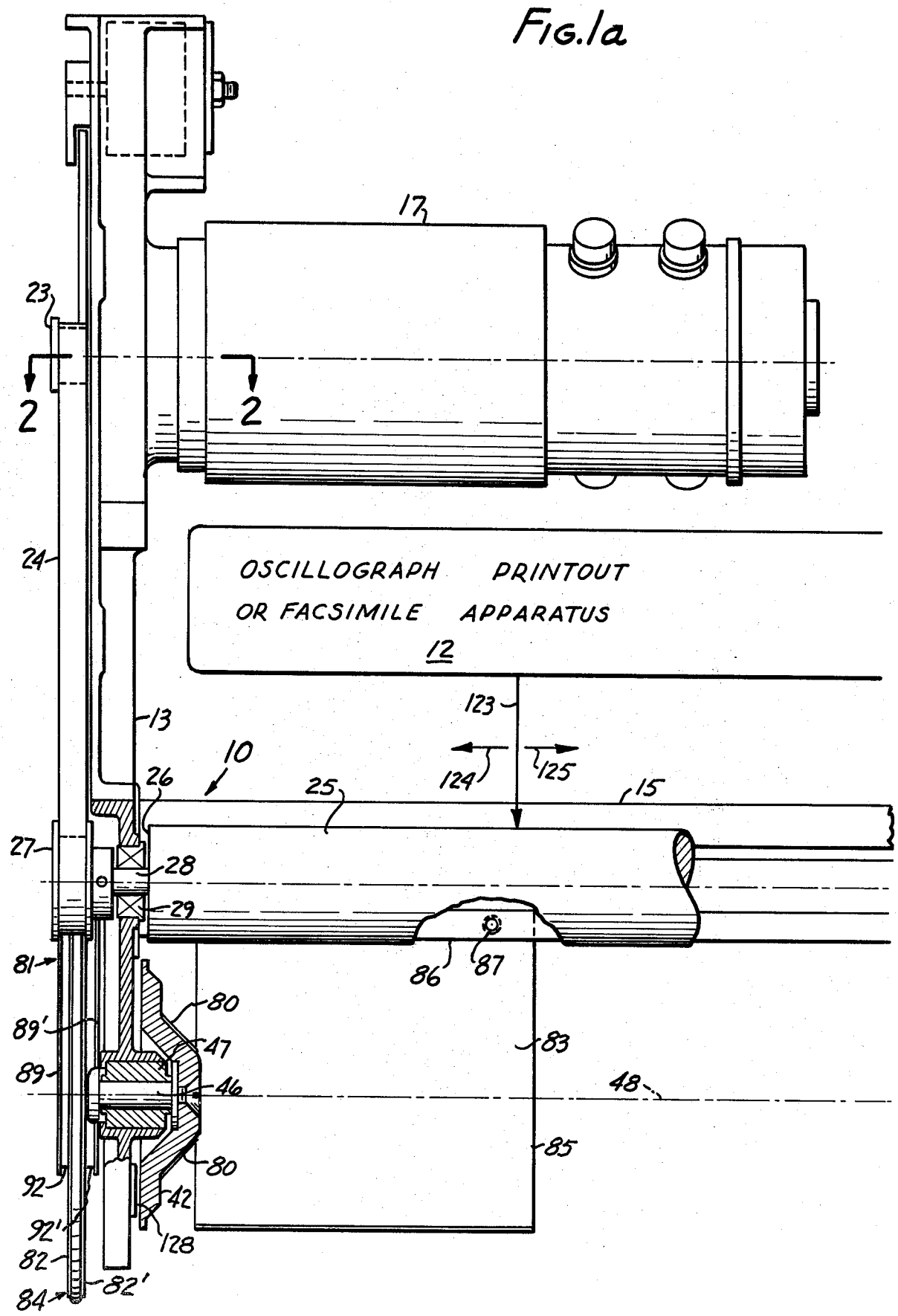
FIGS. 1*a* and *b*, when juxtaposed side by side, constitute a top view, partially in section, of a paper transport for or of an oscillograph apparatus in accordance with a preferred embodiment of the subject invention.

The paper transport according to the illustrated preferred embodiment of the subject invention has utility in all kinds of systems wherein wound paper, recording medium strips or sheets or other materials are to be transported from a supply roll. Without limiting the generality of the foregoing, the subject transport has particular utility in advancing and handling recording media and master records in the oscillograph, printout or facsimili apparatus disclosed in the above mentioned copending patent application and shown symbolically at 12 in FIGS. 1*a* and *d*.

Despite the variety of potential and practical uses of various aspect of the subject invention, the illustrated preferred embodiment is herein simply referred to as "paper transport" without any limiting intent.

The paper transport 10 has a frame or support structure including a lateral frame or upright mounting plate 13 and a lateral frame or upright mounting plate 14 interconnected by a rail 15. In addition, the frame structure may include a baseplate, as well as a housing (not shown) which, particularly in the case of electrooptical apparatus, would be of a light-tight type.

The paper transport 10 has an electric motor 17 attached to the mounting plate 13 and consituting a source of rotary drive power for various rotatable parts of the paper transport.

Figure 2:
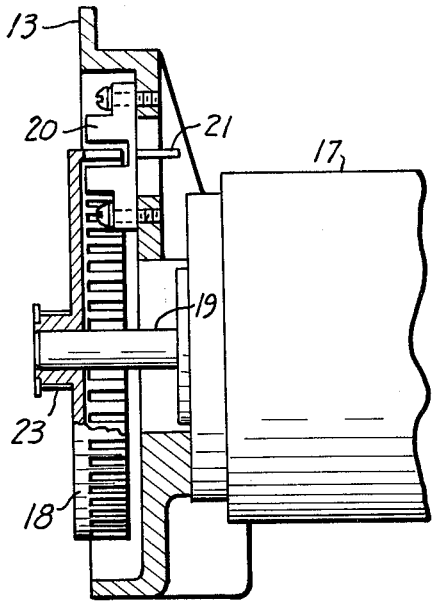
FIG. 2 is a section taken along the line 2—2 in FIG. 1*a;*

As shown in FIG. 2, the motor 17 may have a shutter wheel 18 attached to its drive shaft 19 for generating, with the aid of an electrooptical pickup 20, a train of electrical pulses varying directly with paper velocity. These may be used to scale the rate of deposition of information onto the recording medium, such that the information is recorded at the same relative size regardless of paper speed. In addition, since any paper movement results in a finite number of pulses being generated, the output of electrooptical pickup 20 may be counted and this information utilized to stop the transport after a predetermined length of the recording medium has been transported. The shutter wheel 18 also incorporates output pulley 23 of the motor 17.

A transmission belt 24 engages the motor output pulley 23 and applies rotary drive power to a drive roller 25 at one end 26 thereof via a drive pulley 27. The drive roller 25 has a shaft 28 extending through a bearing 29 in the side plate 13 to the drive pulley 27 at the one end 26. At the other end 31, the drive roller 25 has a shaft 32 extending through a bearing 33 in the side wall 14 of the transport frame.

Figure 1B:
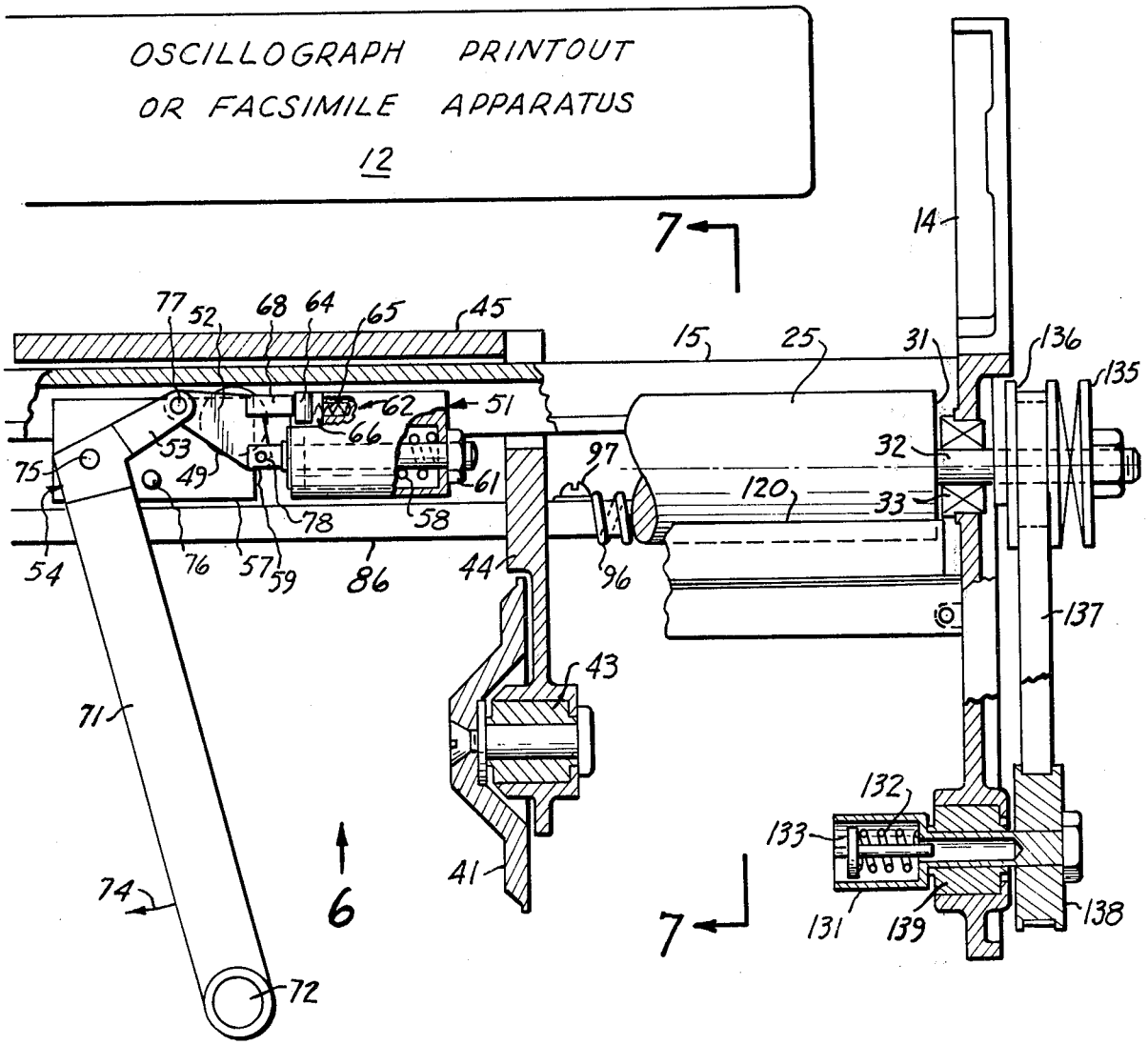
Figure 3:
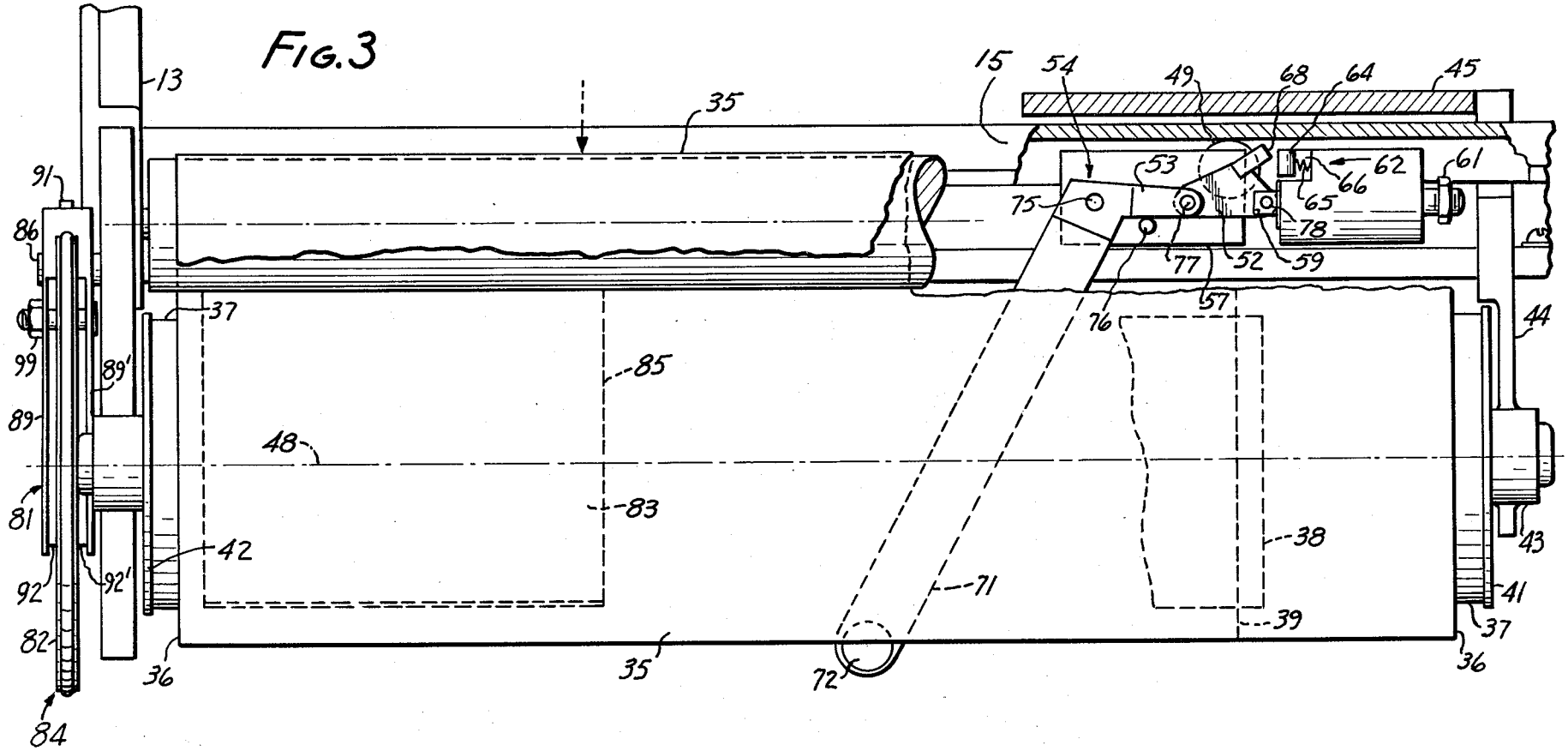
FIG. 3 is a showing of part of the transport of FIGS. 1*a* and *b* in an active position.

An aspect of the subject invention relating to methods and apparatus for releasably retaining any one of several tubular objects of different lengths will now be disclosed with the aid of FIGS. 1*a*, 1*b*, and FIG. 3 in accordance with the illustrated preferred embodiment.

In particular, FIG. 3 shows a supply of wound material, such as an oscillograph paper or other recording medium, situated in a roll 36 on a tubular support 37, such as a cardboard tube.

The paper transport according to the illustrated preferred embodiment of the subject invention is capable of handling oscillograph papers and other recording media of different widths. Accordingly, the tubular supports of various supply rolls usable in the illustrated equipment may be of different lengths.

By way of example, FIG. 3 partially shows by a dotted outline 38 a shorter tubular support for a oscillograph paper supply roll 39 of less width than the supply roll 36.

In practice, all these different oscillograph paper widths and tubular support lengths have to be accommodated in the illustrated apparatus. To this end, the transport 10 has a pair of mutually adjustable retention members 41 and 42.

As shown in FIGS. 16, 3, 6 and 7, the tubular support retention member 41 is rotatably mounted by a bearing 43 in a vertical mounting plate 44 attached to a carriage 45. As seen in FIG. 1*a*, the other tubular support retention member 42 has a shaft 46 extending through a bearing 47 in the relatively stationary mounting plate 13 of the frame and is thus mounted for rotation about an axis 48 extending through, and being a common axis of rotation for, the retention members 41 and 42.

The common axis of rotation 48 and the rail 15 of the frame structure extend parallel to each other, and the rail 15 serves as a track for the carriage 45. To this end, the carriage 45 has rollers 49 riding along the rail 15. A locking device 51 is coupled to the carriage 45 by a pair of links 52 and 53 of a toggle mechanism 54 for movement along the rail 15 along with the carriage 45, and selective movement of the carriage 45 relative to the locking device 51.

Figure 6:
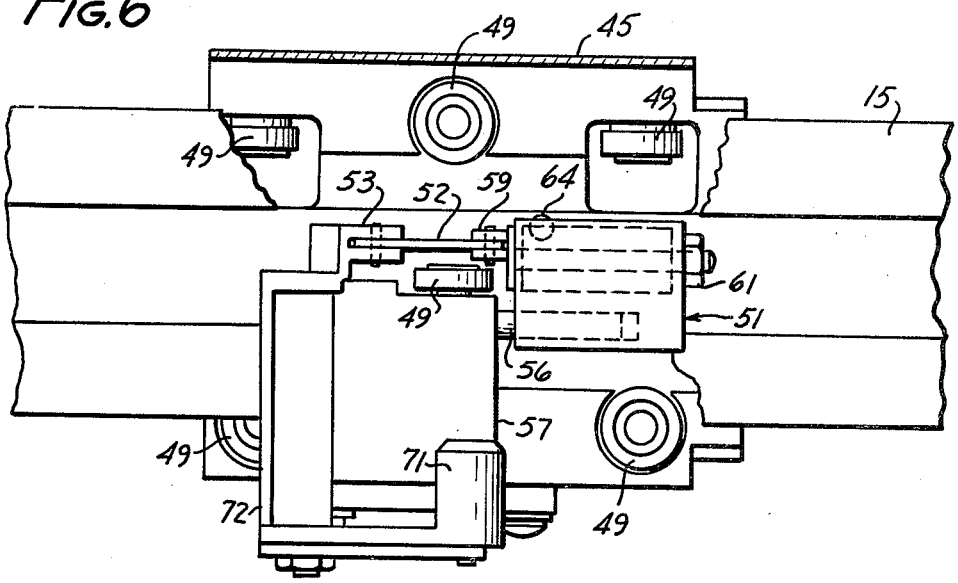
FIG. 6 is a detail view elevation, partially in fraction, as seen in the direction of arrow 6 in FIG. 1*b;*
Figure 7:
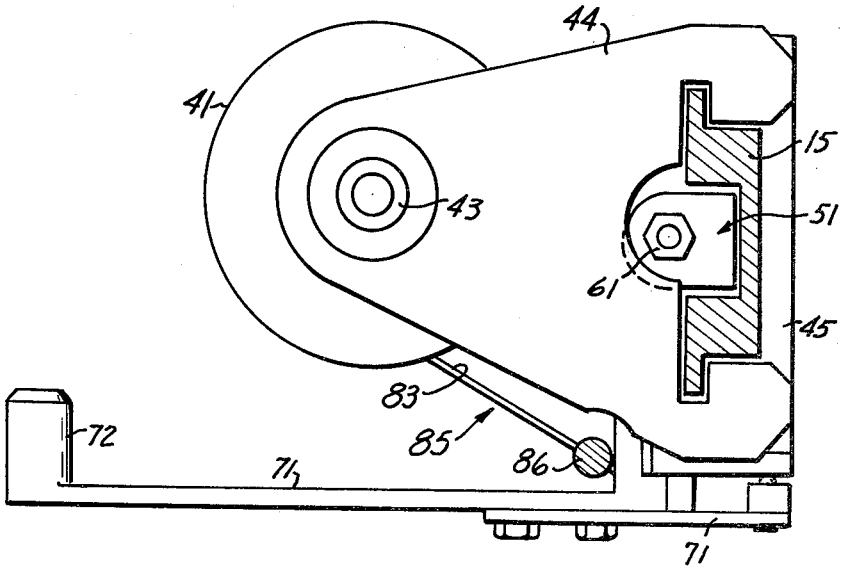
FIG. 7 is a view taken along the line 7—7 in FIG. 1*b;*

The locking device 51 is movably disposed on a guide pin 56 which, as apparent from FIG. 6, projects from a block 57 of the carriage 45 parallel to the rail 15 or common axis of rotation 48 seen in FIGS. 1*a* and *b*. The locking device 51 further has a cavity which houses a preload spring 58. The spring 58 preloads a forked linkage member 59 outwardly against a stop provided by a nut 61.

The locking device 51 includes a clutch 62 for lockingly engaging the rail 15. In accordance with the illustrated preferrred embodiment, the clutch 62 is a selectively actuable one-way clutch including a cylindrical locking member 64 which is biased by a spring 65 up an inclined surface 66. The link 52 of the overcenter toggle mechanism 54 carries a member 68 for releasing the clutch 62 from its locking engagement with the rail 15.

In particular, the toggle mechanism 54 is actuable between a first position shown in FIGS. 1*b*, and 6, and a second position shown in FIG. 3. To this end, the toggle mechanism 54 has an actuating lever 71 and a manually engageable handle 72.

In the first position of the toggle mechanism 54 shown in FIGS. 1*b* and 6, the release member 68 pushes the cylindrical locking member 64 inwardly and thus prevents the spring 65 from pushing the locking member 64 up the inclined surface or ramp 66.

Rather, the locking member 64 remains disengaged from the rail 15 as long as the release member 68 pushes against that locking member in the first position of the toggle mechanism 54. As long as the toggle mechanism is in that first position, the retention member 41, rotatably mounted on the carriage 45, may thus be adjusted not only toward, but also away from the retention member 42 preparatory to the accommodation of any one among several different tubular supports.

In practice, any one of several tubular objects, such as the tubular support 37 of the paper supply roll 36, is placed in the space between the retention members 41 and 42 and the carriage 45 and locking device 51 is moved toward the retention member 42 to adjust the spacing between the retention member 41 and 42 to the length of the placed tubular member or support 37. The retention members 41 and 42 thus engage opposite ends of the tubular support 37. The lever 71 may then be angularly moved in the direction of the arrow 74 shown in FIG. 1*b* for actuating the toggle mechanism in the second illustrated position shown in FIG. 3. In that position, the toggle link 53, being pivoted by a pin 75 attached to the block 57 of the carriage 45, rests against a stop 76 also attached to the block 57. The toggle link 52, being coupled to the link 53 via a pin 77 and to the forked member 59 via a pin 78, assumes the position shown in FIG. 3 in the second position of the toggle mechanism 54. In that position, the release member 68 is deactivated since it is disengaged and spaced from the locking member 64. The spring 65 is thus able to push the locking member 64 up the ramp 66 for an engagement of the locking member with the rail 15. In this respect, FIGS. 1*b* and 3, for the sake of better visibility of details of the locking device 51, show part of the rail 51, which is engaged by the locking member 64, broken away. Reference may in this respect be had to FIG. 6 for a showing of the positional relationship of the locking member 64 to the adjacent longitudinal surface of the rail 15.

The locking device 51 is thus locked to rail 15 and is thus arrested from movement away from the retention member 42. In other words, the retention members 41 and 42 are thus locked against movement away from each other while the locking device 51 is arrested against movement away from the retention member 42.

This locking action takes place during the first portion of the movement of toggle mechanism 54. During the balance of the movement from position 1 to position 2 of the toggle mechanism 54, the links 52 and 53 extend to their fullest length measured between pins 75 and 78. Since locking mechanism 51 is now secured to rail 15 and cannot move away from retention member 42, the carriage 45 with arm 44 and retention member 41 moves toward retention member 42 as the lever 71 is continued to be moved in the direction of arrow 74. In its fully extended position, the lever 71 is releasably retained by a catch 79 mounted on a resilient extension 71' of the lever 71 and entering a depression 79' (see FIG. 5) when the lever 71 assumes its position shown in FIG. 3. The retention member 41 comes to a stop against the previously inserted core 37 and the downwardly swinging links 52 and 53 force forked member 59 to compress spring 58. The supply roll support 37 is thus securely locked between retention members 41 and 42 while the compression of spring 58 allows for any shortcoming of roll support 37 caused by such factors as anti-rotation ridges 80 of retention member 42 digging into the ends of roll support 37.

In contrast to prior-art proposals, the subject invention thus not only permits an infinitesimal or stepless adjustment in the spacing between the retention members 41 and 42 for an accommodation to various supply roll support sizes, but provides also a secure locking action by employment of the illustrated locking device and, preferably, the spring 58, for supply roll clamping purposes only after the above mentioned arrestation of the locking device.

While this aspect of the subject invention has been disclosed herein primarily in terms of releasable supply roll retention, it should be understood that the principles of this aspect are also applicable in general to the task of retaining any one of several tubular objects of different lengths between a pair of mutually adjustable retention members.

Another aspect of the subject invention which has independent utility or may be combined with the aspect just discussed or any other aspect or feature herein disclosed concerns methods and apparatus for supplying wound material from a roll of diminishing diameter at bidirectionally controlled tension.

In terms of the illustrated preferred embodiment, it will be understood that the supply roll 36 diminishes in diameter as the paper or other sheet-like material 35 is unwound therefrom. It is the task of a mechanical servo system 81 to control the tension of the paper 35 bidirectionally; that is irrespective of the sense of rotation of the supply roll 36 as the paper 35 is unwound or pulled off therefrom.

To this end, the mechanical servo system 81 includes a pair of flat friction surfaces 82 and 83. One of these friction surfaces, namely the surface 82 is circular, being provided on a circular disk 84. The other of the pair of friction surfaces, namely the surface 83, is flat, being provided on a sheet of metal or flapper 85. The flapper 85 is attached to a shaft 86 by fasteners, one of which is seen at 87 in FIG. 1*a*. In this manner, the flapper 85 is able to monitor the radius of the paper supply roll 36 for essentially constant paper tension.

The shaft is journaled for angular movement about its longitudinal axis in the lateral mounting plates 13 and 14 of the frame structure.

An arm structure 89 is attached to a projecting end of the shaft 86 by a pin 91. At its outer extremity remote from the shaft 86, the arm structure 89 carries a friction pad 92 for generating friction on the surface 82.

The friction surface 82 or disk 84 is rotatated about an axis 48 perpendicularly intersecting the surface 82 at a distance from the friction generating pad 92. As seen in FIGS. 1*a*, 1*b* and 3, the axis 48 is the common axis of rotation for the retention members 41 and 42 and the friction surface 82 or disk 84. In fact, the disk 84 is mounted on the shaft of the retention member 42 so that the disk 84 with the friction surface 82 is coupled to the retention member 42 for rotation with the supply roll 36 as the paper 35 is unwound therefrom.

The arm structure 89, being attached to the rotatable shaft 86, serves as a means for moving the friction generating pad 92 toward the intersection of the axis 48 with the friction surface 82 along a trajectory or arc of a circle 94 intersecting the axis 48. In practice, this enables an operation of the mechanical servo system 81 in either sense of rotation of the supply roll 36 and disk 84 or friction surface 82 while also enabling the development of a force tending to move the friction generating pad 92 toward the intersection of the axis with the friction surface 82.

Figure 4:
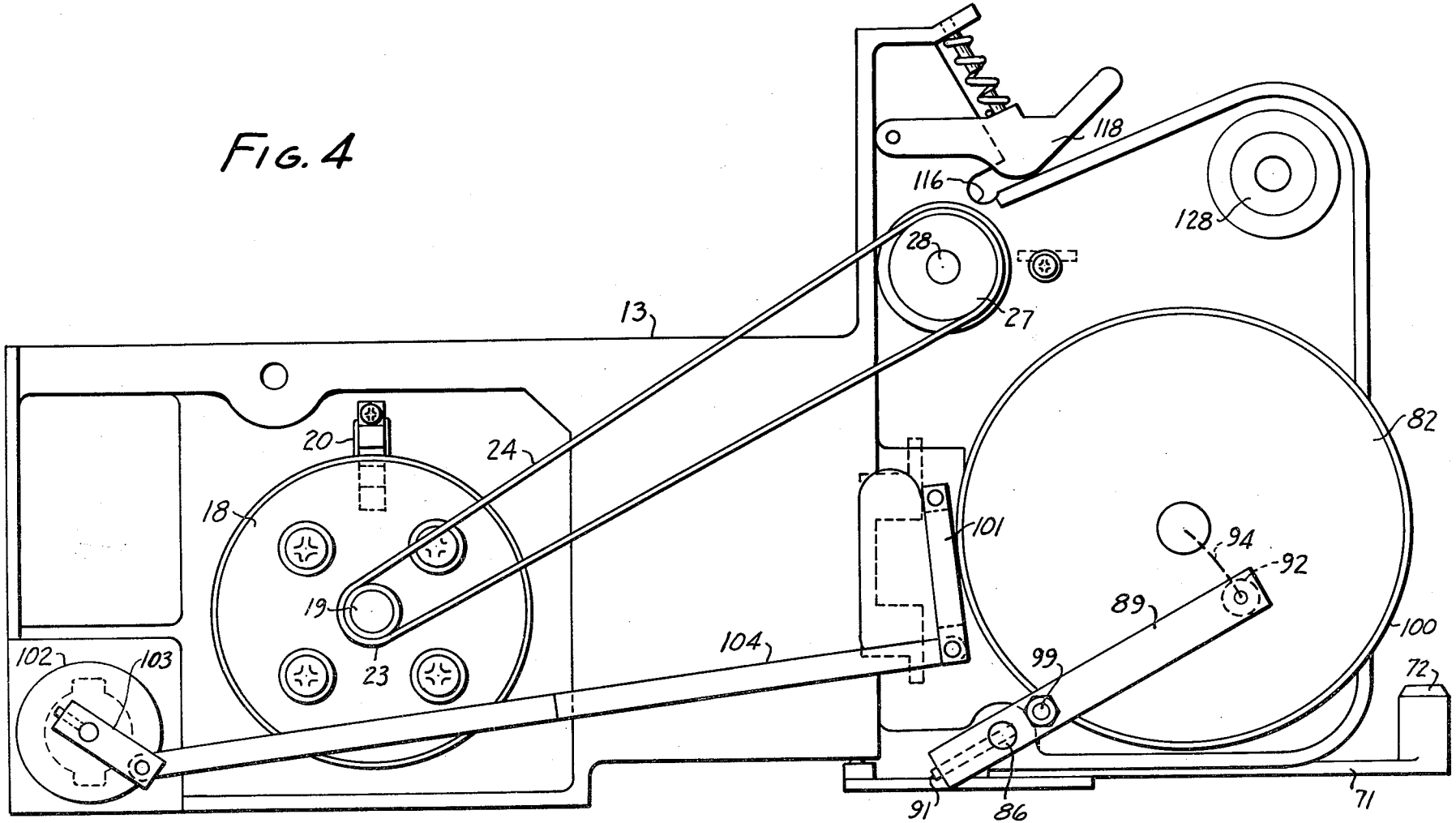
FIG. 4 is a side view of the transport as seen from the left-hand side of FIG. 1*a;*

Referring to FIG. 4, if the supply roll is wound such that paper leaving the roll causes the surfaces 82 to rotate clockwise there will be generated a force component due to the action of pad 92 (or pads 92 and 92') against surface 82 (or surfaces 82 and 82') such that arm 89 and shaft 86 are also rotated clockwise. This force is overcome by helical spring 96 having one end attached to the lateral mounting plate 14 and the other end to shaft 86 at 97 and causing arm 89 and shaft 86 to rotate counterclockwise as viewed in FIG. 4. Should the supply roll be wound in the opposite direction, the surfaces 82 will rotate counterclockwise and a force will be generated tending to rotate arm 89 and shaft 86 counterclockwise. This force will add to the torsional moment generated by spring 96. Regardless of the direction of rotation of surfaces 82 there will be generated sufficient torsional moment applied to shaft 86 to keep monitor surface 83 in contact with supply roll 36 at all times as paper unwinds and diminishes the supply roll size. In this manner, there is generated a torque in disk 84 that is directly proportional to supply roll diameter resulting in constant supply tension in the material being removed from the roll. The rubbing contact of monitor surface 83 with supply roll 36 adds to the supply web tension but, in practice, this force is small compared to total web tension and is relatively constant.

In operation, the flatness and relatively large area of the monitor surface 83 and flapper 85 effectively avoid the disadvantages of prior-art roll diameter rollers, including warping and bulging of the wound material on the roll. Concurrently, the arm structure 89 and its mounting, as well as the location of the friction pads 92 and its movement along the trajectory 94, avoid the prior-art drawback of restriction to operation in only one sense of rotation for the sake of generating the required torsional forces on the monitor shaft.

As seen in FIGS. 1*a* and 3, both sides of the circular disk 84 may be utilized as friction surfaces 82 and 82'. The arm structure 89 may then be provided with a pair of arms, one of these carrying the pad 92 in frictional contact with the surface 82 and the other, shown at 89', carrying a friction pad 92' in frictional engagement with the friction surface 82'. An adjustable tensioning device 99, seen in FIGS. 3 and 4, may be employed for tensioning the arm sections toward each other and the friction pads 92 at 92' into a desired engagement with the circular friction surfaces 82 and 82' on the disk 84.

As seen in FIG. 4, the friction servo disk 84 has a tire 100 which is selectively engaged by a brake 101 whenever power to the drive motor 17 is removed. A rotary solenoid 102 acts on the brake 102 via links 103 and 104. In particular, the solenoid 102 is energized briefly to engage the brake 101 with the tire 100 each time power to the motor 17 is removed. Power is supplied to the solenoid 102 only long enough to cause brake 101 to be applied to the tire 100 to stop the rotation of the supply roll 36 rapidly.

Figure 8:
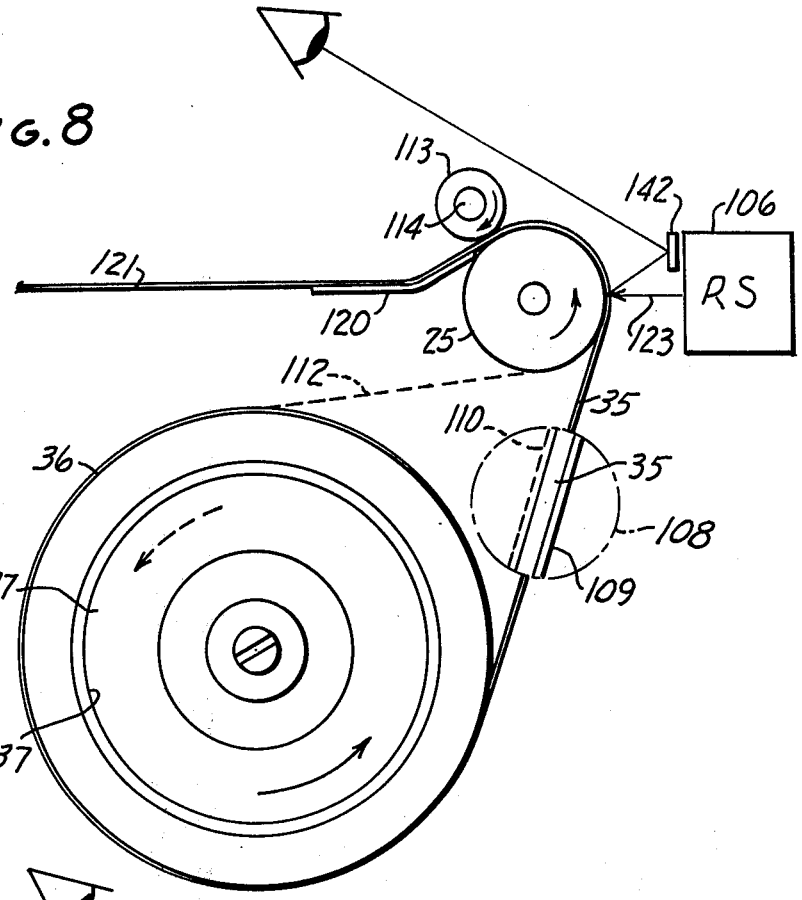
FIG. 8 is a diagrammatic view of a mode of operation of the transport shown in FIGS. 1*a* to 7.
Figure 9:
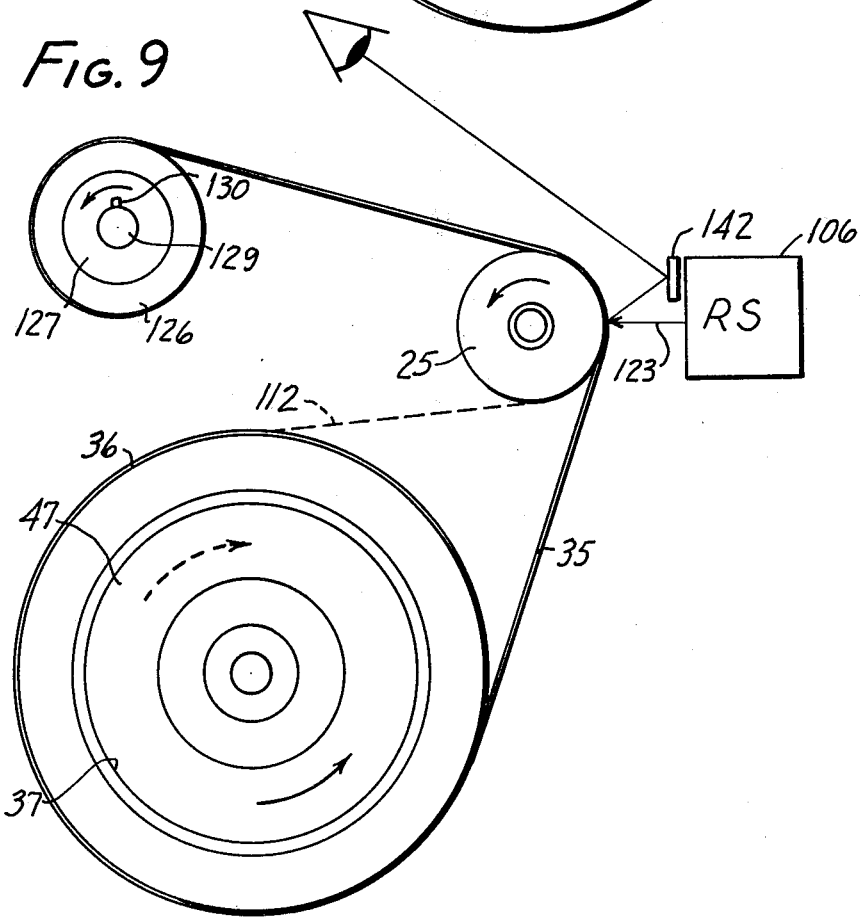
FIG. 9 is a diagrammatic view of a further mode of operation of the transport shown in FIGS. 1*a* to 7.

As seen more specifically in the diagram of FIGS. 8 and 9, the drive roller 25 is rotatably mounted at a recording station 106 including the oscillograph, printout or facsimile apparatus 12 shown in FIGS. 1*a* and *b*.

As shown in FIG. 8 in the magnified view 108, the recording medium strip 35, wound on the supply roll 36, has an information recording surface layer 109 facing outwardly on the supply roll 36.

As indicated by the dotted line 110 in the magnified view 108, the paper transport herein disclosed is also capable of handling recording medium strips having an information recording surface layer facing inwardly when wound on the supply roll.

In practice, the recording medium strip 35 is run from the supply roll 36 about part of the drive roller 25 with the information recording surface layer facing away from the drive roller 25 at the recording station 106 irrespective of the direction in which the recording surface layer faces on the supply roll. To this end, the recording medium strip is run from the supply roll 36 as illustrated by a solid line at 35 in FIGS. 8 and 9 when the information recording surface layer 109 faces outwardly on the supply roll as shown in solid outline in the magnified view 108 in FIG. 8. On the other hand, if the recording surface layer faces inwardly on the supply roll 36, then the recording medium strip is run from the supply roll along a path indicated by a dotted line 112 in FIGS. 8 and 9.

In this manner, the information recording surface layer on the unwound recording medium strip 35 always faces away from the drive roller 25 in the direction of the oscillograph, printout or facsimile apparatus 12.

Figure 5:
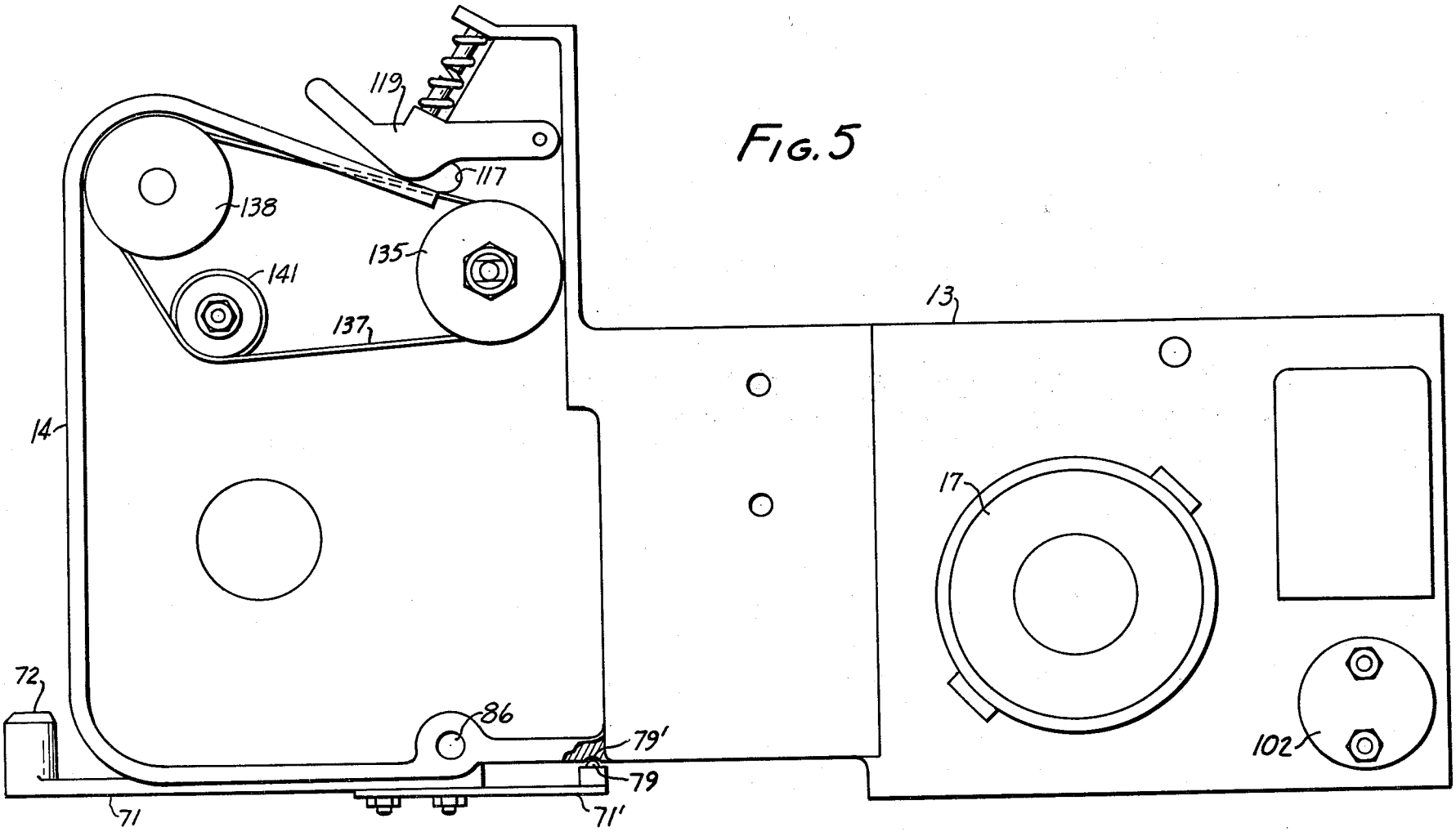
FIG. 5 is a further side view of the transport as seen from the right-hand side of FIG. 1*b;*

In the embodiment illustrated in FIG. 8, an idler roller 113 having a shaft or projecting shaft ends 114 is provided for pressing the recording medium strip 35 at the recording station against the drive roller. To this end, and as shown in FIGS. 4 and 5, the lateral mounting plates 13 and 14 are provided with notches 116 and 117 near the drive roller 25 for receiving the shaft or shaft ends 114 of the idler roller 113.

Manually actuable spring bias grips are provided adjacent the notches 116 and 117 for releasably retaining the idler roller 113 via shaft or shaft ends 114 at the drive roller 25. The idler roller 113 causes sufficient frictional force to be developed between drive roller 25 and recording medium 35 that it is withdrawn from the supply roll 36 and discharged from the recording station with the aid of a deflection plate 120 as seen at 121 in FIG. 8.

The recording medium strip is thus driven through the recording station and information is recorded on successive portions of the recording medium strip while each of these portions is located on the drive roller 25 with its information recording surface layer facing away from the drive roller. An arrow 123 in FIGS. 1*a*, 8 and 9 indicates the luminous output in the case of an oscillograph apparatus, or the luminous sensing beam in the case of facsimile equipment, or then another stimulus in the case of a printout peripheral. Arrows 124 and 125 in FIG. 1*a* indicate that the beam 124 typically is deflected laterally during operation of the equipment.

FIG. 9 illustrates a variance in which the recording medium strip 35, after having run past the recording station and the drive roller 25, is wound in a roll 126 on a takeup roller 127.

To this end, and as shown in FIGS. 1*a* and 4 and 9, the paper transport is provided with a bearing socket 128 for receiving a shaft end 129 of the takeup roller. The other shaft end of the takeup roller, having typically a key 130, is received in a corresponding socket 131 that has a spring 132 cooperating with a driving member 133 for releasably retaining the takeup roller in the paper transport.

While rotary drive power is applied to one end of the drive roller 25 at its shaft 28, rotary drive power is derived from the drive roller 25 at its other end via a slip clutch 135 coupled to the shaft 32, a pulley 36 connected to the slip clutch 135, a transmission belt 137 running from the pulley 136 to a pulley 138 connected to the takeup roller shaft receiving socket 131 via a bearing 139 located in the lateral mounting plate 14. In this manner, drive power for the takeup roller is derived from the other end of the drive roller 25 and is applied to the takeup roller 127 via the rotary socket 131.

In accordance with the illustrated embodiment of the invention, and in contrast to certain prior-art proposals, the drive roller 25 is maintained in its rotatably mounted condition and position at the recording station while the discharged recording medium strip is wound into a takeup roll 126 at a location spaced from the drive roller. This considerably simplifies the paper transport while maintaining its precision and high reliability.

As shown in FIG. 5, the means for picking up rotary drive power from the drive roller 25 and for applying that picked-up rotary drive power to the takeup roller 127 include an idler roller 141 rotatably mounted on the lateral frame plate 114 for maintaining the transmission belt 137 suitably tensioned. As shown in FIGS. 8 and 9, a mirror 142 may be mounted at the recording station to permit visual observation of the oscillograph trace or other data before the recording even appears on the recording medium strip or, if the recording medium is wound on a takeup roller, before the resulting record becomes available for inspection.

Figure 12:
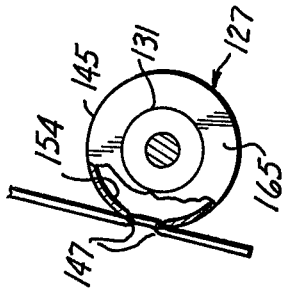
FIG. 12 is a view taken along the line 12—12 in FIG. 11.
Figure 10:
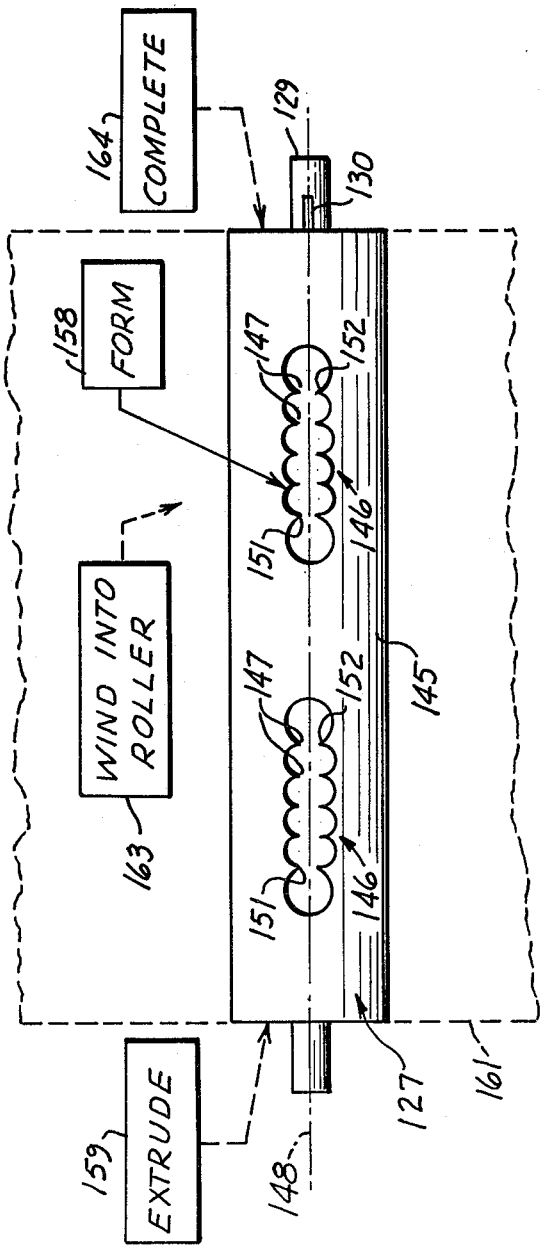
FIG. 10 is a frontal view of a takeup roller in accordance with a preferred embodiment of the subject invention useful in the apparatus shown in FIGS. 1*a* to 7, and a showing of methods for making a takeup roller in accordance with preferred embodiments of the subject invention.
Figure 11:
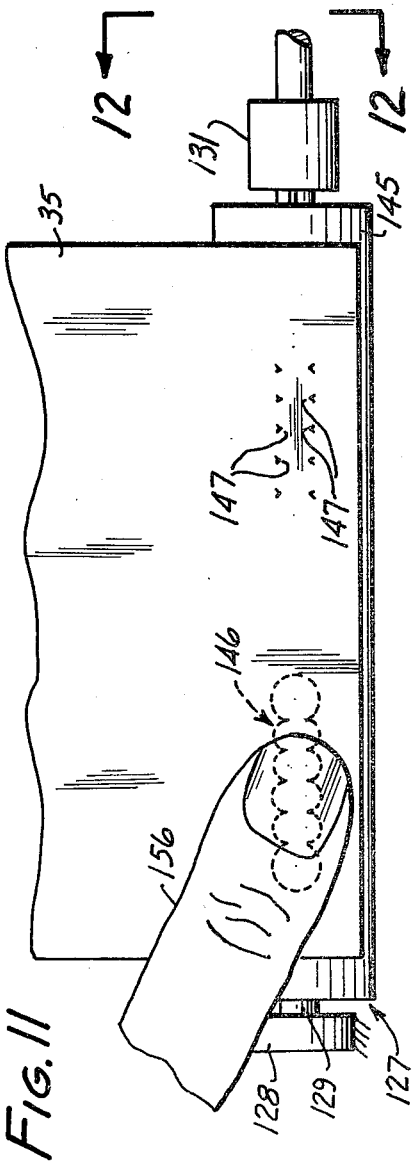
FIG. 11 is a view similar to FIG. 10 illustrating a method of attaching a sheet of pierceable material to the roller of FIG. 10.

The takeup roller 127 shown in FIGS. 10 to 12 has an outer cylindrical surface 145. An opening 146 is provided or extends through the cylindrical surface 145 into the roller 127 for receiving a portion of the sheet 35 at one of its major surfaces at a distance from its free end, as seen in FIG. 11. Sets 151 and 152 of pluralities of sharp teeth 147 face each other across the opening 146 at the cylindrical surface 145. As seen in FIGS. 10 and 12, each opening extends for an unobstructed free path from one set of teeth 151 to an opposite set of teeth 152 for receiving the sheet 35 in piercing engagement with the sets of teeth 151 and 152 at one of the major surfaces of the sheet, as seen in FIGS. 11 and 12, and as more fully described below. In the illustrated preferred embodiment, at least a number of the teeth 147 is aligned in parallel to an axis of rotation of the roller 127.

Also according to the illustrated preferred embodiment, the opening 146 extends between the teeth 147 and is open at all times until closed by application of the sheet 35 to the roller at the opening 146 as seen in FIGS. 11 and 12 and more fully described below. The opening 146 preferably extends between a first number 151 of the teeth 147 and a second number 152 of these teeth. In particular, the first number 151 of the teeth 147 is aligned in parallel to the axis of rotation 148 of the roller 127 along one side of the opening 146, and the second number 152 of the teeth 147 is aligned in parallel to the axis of rotation 148 along another side of the opening. In practice, this permits not only a solid grip on the paper or other sheet of material 35, but also permits bidirectional operation of the takeup roller.

In principle, the roller 127 may be a solid body, in which case the opening 146 with bordering teeth 147 is preferably milled into the roller body, with material being preferably nibbled away from under the location of the teeth being formed at the borders of the opening 146.

The opening 146 with teeth 147 may be duplicated or multiplied in the roller 127 as desired or necessary. Thus, FIGS. 10 and 11, by way of example, show two openings with teeth 147 aligned in parallel to the axis of rotation 148 of the takeup roller.

In accordance with a preferred embodiment of the subject invention, and as shown in FIG. 12, the roller 127 is tubular, having a hollow-cylindrical wall 154. The opening 146 then is an aperture through the hollow cylindrical wall 154 and the teeth 147 are integral with that hollow cylindrical wall. In fact, the teeth 147 are formed of the material of the hollow cylindrical wall 154.

The recording medium or other sheet of pierceable material 35 is attached to the roller 127 by applying a portion of the sheet 35 to that roller and piercing the sheet with the teeth 147. In particular, and as shown in FIG. 11, the sheet 35 may be pierced with the teeth 147 by depressing the sheet at its applied portion into the opening or openings 146. As shown in FIG. 11, a human thumb or other finger 156 may be used for that purpose.

As seen in FIGS. 11 and 12, one of two major surfaces of the sheet 35 is applied to the roller 127 at the opening or openings 146. As seen particularly well in FIG. 12, the sheet 35 is applied to the roller 127 at a distance from the free end of the sheet. As seen in FIG. 11, the sheet is pierced with the teeth 147 by applying a finger 156 to the other of the two major faces of the sheet 35 and depressing a portion of the sheet at opening 146 with the applied finger into that opening at said distance from the free sheet end to attach the sheet to the roller as seen in FIG. 12.

Figure 13:
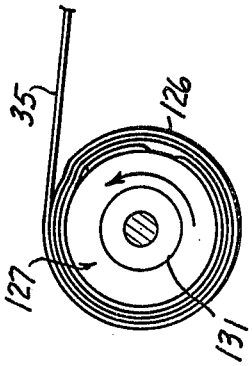
FIG. 13 is a view similar to FIG. 12 showing the winding of paper or another sheet onto the takeup roller of FIG. 10.

As further shown in FIG. 11, the keyed shaft end of the roller 127 may be inserted into the above mentioned socket 131 and the other shaft end may be received in the socket 128. As shown in FIG. 1*b*, the socket 131 is rotated to rotate the roller 127 about the axis 148 for winding the attached sheet 35 onto the takeup roller as in the embodiment of FIGS. 9 and 13.

In a prototype of the illustrated preferred embodiment, the means and method for attaching the sheet 35 to the takeup roller as shown in FIGS. 10 to 13 have proved superior in terms of operating convenience, rapid attachability and subsequent detachability, and regularity of the wound roll to prior-art methods and devices which employ merely a slot in the takeup roller or include fastening or attachment devices projecting outwardly of the cylindrical roller surface 147.

In practice, the opening 136 with bordering teeth 147 may be provided by a variety of methods, including, for example, drilling, milling, chemical etching, photoetching, punching, or forming in the course of an injection molding process. These opening and teeth forming methods are symbolized in FIG. 10 by a box 158.

As indicated at 159 in FIG. 10, the hollow-cylindrical wall 154 of the roller 127 may be manufactured by extrusion.

On the other hand, and as shown by a broken outline 161, a flat sheet of metal or another rigid or rigidifiable material may first be provided. The opening or openings 146 with teeth 147 may then be formed in that flat sheet of material by any of the above mentioned methods. It is, however, a special advantage of the currently discussed method that the opening or openings 146 with teeth 147 can conveniently be punched into the flat sheet of material.

The openings 146 and teeth 147 having been provided, the flat sheet of material 161 is wound or bent into a hollow-cylindrical object, such as the hollow-cylindrically walled tube shown in FIG. 12. This is symbolized at 163 in FIG. 10.

As further symbolized at 164 in FIG. 10, the tubular or hollow-cylindrical object formed by extrusion 159 or bending 163 is then completed into a roller 127. In practice, this may comprise an attachment of circular end plates, such as shown at 165 in FIG. 12 to the opposite ends of the tubular body or hollow-cylindrical object and the provision of a shaft or attachment of shaft ends 129.

I claim:

1. In a method of releasably retaining any one of several tubular objects of different lengths between a pair of mutually adjustable retention members, with the aid of a carriage movable relative to one of said retention members, a locking member, and a spring, the improvement comprising in combination the steps of:

positioning said spring against said locking member;

mounting the other of said retention members on said carriage;

rendering said locking member movable along with said carriage and said carriage movable relative to said locking member;

placing said retention members against opposite ends of any one of said tubular objects by moving the carriage and the locking member toward said one retention member;

arresting said locking member against movement away from said one retention member;

moving said carriage and said other retention member toward said one retention member after said arrestation of the locking member, until said retention member comes to a stop against said one tubular object; and resiliently biasing one of said retention members against said one tubular object and said one tubular object against the other retention member by compression of said spring against said locking member.

2. A method as claimed in claim 1, including the step of:

mounting said retention members for rotation about an axis of rotation common to said retention members.

3. In a method of releasably retaining any one of several tubular objects of different lengths between a pair of mutually spaced retention members, with the aid of a carriage movable relative to one of said retention members, and a locking member, the improvement comprising in combination the steps of:

mounting the other of said retention members on said carriage;

rendering said locking member movable along with said carriage and said carriage movable relative to said locking member;

placing any one of said tubular objects in the space between said retention members;

moving said carriage and locking member toward said one retention member to adjust the spacing between said retention members to the length of said placed tubular member;

arresting said locking member against movement away from said one retention member; and clamping said placed tubular member between said retention members by moving said carriage relative to said arrested locking member toward said one retention member.

4. A method as claimed in claim 3, including the step of:

biasing said carriage away from said arrested locking member only after arrestation of said locking member.

5. A method as claimed in claim 3, including the steps of:

providing a resilient biasing device; and clamping said placed tubular member by moving said carriage via said resilient biasing device away from said arrested locking device and toward said one retention member.

6. A method as claimed in claim 3, 4 or 5, including the step of:

mounting said retention members for rotation about an axis of rotation common to said retention members.

7. In a method of supplying wound material from a roll of diminishing diameter located on a tubular support, with the aid of a pair of mutually adjustable retention members, with the aid of a carriage movable relative to one of said retention members, a locking member, and a spring, the improvement comprising in combination the steps of:

positioning said spring against said locking member;

mounting the other of said retention members on said carriage;

rendering said locking member movable along with said carriage and said carriage movable relative to said locking member;

placing said retention members against opposite ends of said tubular support by moving the carriage and the locking member toward said one retention member;

arresting said locking member against movement away from said one retention member;

moving said carriage and said other retention member toward said one retention member after said arrestation of the locking member, until said retention member comes to a stop against said one tubular object;

resiliently biasing one of said retention members against said tubular support and said tubular support against the other retention member by compression of said spring against said locking member;

providing a pair of friction surfaces;

generating friction at a location on one of said surfaces;

rotating said one surface about an axis perpendicularly intersecting said one surface at a distance from said location and generating at said location, at least during some rotations of said one surface, a force tending to move said location toward said intersection of said axis with said one surface;

transmitting said force to the other of said friction surfaces and applying said other friction surface to said roll;

moving said location of friction towards said intersection along a trajectory intersection said axis, and maintaining said other surface in frictional engagement with said roll, as the diameter of said roll diminishes; and coupling a said retention member to said rotating one surface for rotation therewith.

8. A method as claimed in claim 7, including the step of:

moving said location of friction along a circular arc intersecting said axis.

9. A method as claimed in claim 7, including the steps of:

providing a resilient biasing device; and clamping said placed tubular support with said retention members with the aid of said biasing device.

10. A method as claimed in claim 7, 8 or 9, including the step of:

mounting said retention members for rotation about an axis of rotation common to said retention members.

11. A method as claimed in claim 7 or 8, including the steps of:

making one of said friction surfaces circular and both of said friction surfaces flat.

12. A method as claimed in claim 7, including the steps of:

resiliently biasing said other surface toward said roll.

13. A method as claimed in claim 7, including the step of:

mounting said retention members and said one surface for rotation about a common axis.

14. In a method of supplying wound material from a roll of diminishing diameter located on a tubular support, with the aid of a pair of mutually spaced retention members, a carriage movable relative to one of said retention members, and a locking member, the improvement comprising in combination the steps of:

mounting the other of said retention members on said carriage;

rendering said locking member movable along with said carriage and said carriage movable relative to said locking member;

placing said tubular support in the space between said retention members;

moving said carriage and locking member toward said one retention member to adjust the spacing between said retention members to the length of said placed tubular support;

arresting said locking member against movement away from said one retention member;

clamping said placed tubular support between said retention members by moving said carriage relative to said arrested locking member toward said one retention member;

providing a pair of friction surfaces;

generating friction at a location on one of said surfaces;

rotating said one surface about an axis perpendicularly intersecting said one surface at a distance from said location, and generating at said location, at least during some rotations of said one surface, a force tending to move said location toward said intersection of said axis with said one surface;

coupling a said retention member to said rotating one surface for rotation therewith;

transmitting said force to the other of said friction surfaces and applying said other friction surface to said roll;

moving said location of friction toward said intersection along a trajectory intersecting said axis, and maintaining said other surface in frictional engagement with said roll, as the diameter of said roll diminishes.

15. A method as claimed in claim 14, including the step of:

biasing said carriage away from said arrested locking member.

16. A method as claimed in claim 14, including the steps of:

providing a resilient biasing device; and clamping said placed tubular support by moving said carriage via said resilient biasing device away from said arrested locking device and toward said one retention member.

17. A method as claimed in claim 14, 15 or 16, including the step of:

mounting said retention members for rotation about an axis of rotation common to said retention members.

18. A method as claimed in claim 14, 15 or 16, including the steps of making one of said friction surfaces circular and both of said friction surfaces flat.

19. A method as claimed in claim 14, including the step of:

resiliently biasing said other surface toward said roll.

20. A method as claimed in claim 14 or 19, including the step of:

coupling said one surface to one of said retention members; and mounting said retention members and said one surface for rotation about a common axis.

21. An apparatus for releasably retaining any one of several tubular objects of different lengths, comprising in combination:

a pair of mutually adjustable retention members;

rail means extending parallel to an axis through said retention members;

means coupled to said retention members and including a carriage riding on said rail means for placing said retention members against opposite ends of any one of said tubular objects;

means connected to said placing means for locking said placed retention members against movement away from each other, including locking means movable along said rail means;

means coupled to said locking means for selectively arresting said locking means relative to said rail means;

means coupled to said carriage and locking means for moving said carriage relative to said arrested locking means; and means for resiliently biasing one of said retention members against said one tubular object and said one tubular object against the other retention member, including a spring and a linkage member coupled to said carriage and said spring for compressing said spring against said arrested locking member.

22. An apparatus as claimed in claim 21, including:

means coupled to said retention members for mounting said retention members for rotation about an axis of rotation common to said retention members.

23. An apparatus for releasably retaining any one of several tubular objects of different lengths, comprising in combination:

a pair of mutually spaced retention members for receiving any one of said tubular objects therebetween;

rail means extending parallel to an axis through said retention members;

means for mounting one of said retention members relative to the other retention member, including a carriage movable along said rail means relative to said other retention member, and means for mounting said one retention member on said carriage, for an adjustment of the spacing between said retention members to the length of any selected one of said tubular objects;

locking means movable along said rail means;

means coupled to said locking means for selectively arresting said locking means against movement away from said other retention member; and means coupled to said carriage and locking means for moving said carriage relative to said arrested locking means toward said other retention member for clamping said selected tubular object between said retention members.

24. An apparatus as claimed in claim 23, wherein:

said locking means include selectively actuable clutch means for lockingly engaging said rail means when actuated; and said arresting means include means coupled to said clutch means for selectively actuating said clutch means.

25. An apparatus as claimed in claim 23, wherein:

said locking means include clutch means for lockingly engaging said rail means and means for selectively releasing said clutch means from said locking engagement; and said arresting means include means coupled to said releasing means for selectively deactivating said releasing means.

26. An apparatus as claimed in claim 23, wherein:

said locking means include selectively actuable one-way clutch means for lockingly engaging said rail means when actuated against movement of said locking means away from said other retention member;

said arresting means include means coupled to said clutch means for selectively actuating said clutch means.

27. An apparatus as claimed in claim 23, wherein:

said locking means include one-way clutch means for lockingly engaging said rail means against movement of said locking means away from said other retention member; and means for selectively releasing said clutch means from said locking engagement; and said arresting means include means coupled to said releasing means for selectively deactivating said releasing means.

28. An apparatus as claimed in claim 25 or 27, wherein:

said clutch means include a locking device;

said releasing means include a release member engaging and deactivating said locking device; and said arresting means include means coupled to said release member for selectively removing said release member from engagement with said locking device.

29. An apparatus as claimed in claim 23, 24, 25, 26 or 27, including:

spring means between said carriage and said locking means for biasing said carriage away from said locking member and means for activating said spring means only after arrestation of said locking member.

30. An apparatus as claimed in claim 23, 24, 25, 26 or 27, including:

spring means coupled to said locking means; and a toggle mechanism coupled to said spring means and said carriage for selectively biasing said carriage away from said locking means.

31. An apparatus as claimed in claim 23, including:

spring means coupled to said locking means;

clutch means in said locking means for lockingly engaging said rail means; and a toggle mechanism coupled between said spring means and said carriage and including means for actuating said toggle mechanism between first and second positions, means for releasing said clutch means from said locking engagement in said first position and for deactivating said releasing means in said second position, and means for biasing said carriage with said spring away from said locking means in said second position.

32. In apparatus for supplying wound material from a roll of diminishing diameter located on a tubular support, the improvement comprising in combination:

a pair of mutually adjustable retention members for retaining opposite ends of said tubular support;

rail means extending parallel to an axis through said retention members;

a carriage riding on said rail means and mounting one of said retention members;

means for selectively locking said retention members against movement away from each other, including locking means movable along said rail means;

means coupled to said locking means for selectively arresting said locking means relative to said rail means;

means coupled to said carriage and locking means for moving said carriage relative to said arrested locking means;

means for resiliently biasing said one retention member against said tubular support and said tubular support against the other retention member, including a spring and a linkage member coupled to said carriage and said spring for compressing said spring against said arrested locking member;

a pair of friction surfaces;

means for generating friction on one of said surfaces;

means coupled to said one surface for rotating said one surface about an axis perpendicularly intersecting said one surface at a distance from said friction generating means;

means coupled to said friction generating means for generating at said friction generating means, at least during some rotations of said one surface, a force tending to move said friction generating means toward said intersection of said axis with said one surface;

means coupled to said friction generating means and the other of said friction surfaces for transmitting said force to said other friction surface and applying said other friction surface to said roll;

means coupled to said friction generating means for moving said friction generating means toward said intersection along a trajectory intersecting said axis and for maintaining said other surface in frictional engagement with said roll, as the diameter of said roll diminishes; and means coupled to said one friction surface for coupling a said retention member to said one surface for rotation therewith.

33. An apparatus as claimed in claim 32, including:

means for mounting said retention members for rotation about an axis of rotation common to said retention members.

34. An apparatus as claimed in claim 32 or 33, wherein:

said one friction surface is circular and both of said friction surfaces are flat.

35. An apparatus as claimed in claim 32, including:

means coupled to said other friction surface for resiliently biasing said other surface toward said roll.

36. An apparatus as claimed in claim 32, including:

means for mounting said retention members and said one surface for rotation about a common axis.

37. An apparatus for supplying wound material from a roll of diminishing diameter located on a tubular support, comprising in combination:

a pair of mutually spaced retention members for receiving said tubular support therebetween;

rail means extending parallel to an axis through said retention members;

means for mounting one of said retention members relative to the other retention member, including a carriage movable along said rail means relative to said other retention member, and means for mounting said one retention member on said carriage, for an adjustment of the spacing between said retention members to the length of said tubular support;

locking means movable along said rail means;

means coupled to said locking means for selectively arresting said locking means against movement away from said other retention member;

means coupled to said carriage and locking means for moving said carriage relative to said arresting locking means toward said other retention member for clamping said tubular support between said retention members;

a pair of friction surfaces;

means for generating friction on one of said surfaces;

means coupled to said one surface for rotating said one surface about an axis perpendicularly intersecting said one surface at a distance from said friction generating means;

means coupled to said friction generating means for generating at said friction generating means, at least during some rotations of said one surface, a force tending to move said friction generating means toward said intersection of said axis with said one surface;

means for coupling a said retention member to said rotating one surface for rotation therewith;

means coupled to said friction generating means and the other of said friction surfaces for transmitting said force to said other friction surface and applying said other friction surface to said roll;

means coupled to said friction generating means for moving said friction generating means toward said intersection along a trajectory intersecting said axis and for maintaining said other surface in frictional engagement with said roll, as the diameter of said roll diminishes.

38. An apparatus as claimed in claim 37, including:

means coupled to said carriage and locking means for biasing said carriage away from said arrested locking means.

39. An apparatus as claimed in claim 37, including:
a resilient biasing device; and
means coupled to said resilient biasing device and said carriage for clamping said tubular support between said retention members.

40. An apparatus as claimed in claim 37, 38 or 39, including:
means for mounting said retention members for rotation about an axis of rotation common to said retention members.

41. An apparatus as claimed in claim 37, 38 or 39, wherein:
said one of said friction surfaces is circular and both of said friction surfaces are flat.

42. An apparatus as claimed in claim 37, including:
means coupled to said other friction surface for resiliently biasing said other surface toward said roll.

43. An apparatus as claimed in claim 37 or 42, including:
means for mounting said retention members and said one surface for rotation about a common axis.

44. A method of attaching a sheet of pierceable material having opposite major surfaces and a free end to a roller having an outer cylindrical surface, comprising in combination the steps of:
providing an opening through said cylindrical surface into said roller and defining part of said opening with a plurality of sharp teeth at said cylindrical surface; and
applying one of said major surfaces of said sheet to said roller at said opening and at a distance from said free end and piercing said sheet with said teeth by applying a finger to the other of said major surfaces of the sheet and depressing a portion of the sheet at said opening with the applied finger into said opening a said distance from the free end to attach said sheet to said roller.

45. A method as claimed in claim 44, wherein:
said opening and teeth are provided by etching into said roller.

46. A method as claimed in claim 44, including the steps of:
providing a flat sheet of material;
providing said opening and teeth in said flat sheet of material;
bending said flat sheet of material having said opening and teeth into a hollow-cylindrical object; and
completing said hollow-cylindrical object into a roller.

47. A method as claimed in claim 46, wherein:
said opening and teeth are provided by punching said flat sheet prior to its bending into a hollow-cylindrical object.

48. A method as claimed in claim 44, wherein:
at least a number of said teeth is aligned in parallel to an axis of rotation of said roller.

49. A method as claimed in claim 44, wherein:
a first number of said teeth is aligned in parallel to an axis of rotation of said roller along one side of said opening; and
a second number of said teeth is aligned in parallel to an axis of rotation of said roller along another side of said opening.

50. A method as claimed in claim 44, wherein:
said opening extends between a first number of said teeth and a second number of said teeth.

51. A method as claimed in claim 44, 45, 46, 47, 48, 49, or 50, including the step of:
rotating said roller having said sheet attached thereto for winding said sheet onto said roller.

52. A method of winding a sheet of pierceable material having opposite major surfaces and a free end onto a tubular roller having a hollow-cylindrical wall, comprising in combination the steps of:
providing an opening through said hollow-cylindrical wall and defining part of said opening with a plurality of sharp teeth formed of portions of said hollow-cylindrical wall;
applying one of said major surfaces of said sheet to said hollow-cylindrical wall at said opening and at a distance from said free end and piercing said sheet with said teeth by applying a finger to the other of said major surfaces of the sheet and depressing a portion of the sheet at said opening with the applied finger into said opening at said distance from the free end to attach said sheet to said roller; and
rotating said roller having said sheet attached thereto for winding said sheet onto said roller.

53. A method as claimed in claim 52, wherein:
said teeth are provided by etching said opening through said hollow-cylindrical wall with a serrated border.

54. A method as claimed in claim 52, wherein:
said opening and teeth are provided by milling said hollow-cylindrical wall.

55. A method as claimed in claim 52, wherein:
at least a number of said teeth is aligned in parallel to an axis of rotation of said roller.

56. A method as claimed in claim 52, wherein:
a first number of said teeth is aligned in parallel to an axis of rotation of said roller along one side of said opening; and
a second number of said teeth is aligned in parallel to an axis of rotation of said roller along another side of said opening.

57. A method as claimed in claim 52, wherein:
said opening extends between a first number of said teeth and a second number of said teeth.

58. In apparatus for winding a sheet of pierceable material having opposite major surfaces and a free end, the improvement comprising in combination:
a roller having an outer cylindrical surface;
an opening through said cylindrical surface and into said roller for receiving a portion of said sheet at one of said major surfaces at a distance from said free end;
means for attaching said sheet to said roller including sets of pluralities of sharp teeth facing each other across said opening at said cylindrical surface, said opening extending for an unobstructed free path from one set of said teeth to an opposite set of said teeth for receiving said sheet in piercing engagement with said sets of teeth at said one major surface, and being open at all times until closed by application of said sheet to said roller at said opening; and
means coupled to said roller for rotating said roller about an axis of rotation whereby to wind said attached sheet onto said roller.

59. Apparatus as claimed in claim 58, wherein:
said roller is tubular, having a hollow-cylindrical wall;
said opening is an aperture in said hollow-cylindrical wall; and
said teeth are integral with said hollow-cylindrical wall.

60. Apparatus as claimed in claim 58 or 59, wherein: said opening extends between a first number of said teeth and a second number of said teeth.

61. Apparatus as claimed in claim 58 or 59, wherein: at least a number of said teeth is aligned in parallel to said axis of rotation.

62. Apparatus as claimed in claim 58 or 59, wherein: a first number of said teeth is aligned in parallel to said axis of rotation along one side of said opening; and a second number of said teeth is aligned in parallel to said axis of rotation along another side of said opening.

63. In a method of recording information, with the aid of a recording station and a drive roller, on a recording medium strip wound on a supply roll and having an information recording surface layer selectively facing inwardly and outwardly on said supply roll, the improvement comprising in combination the steps of:

providing a pair of mutually adjustable supply roll retention members;

providing a carriage movable relative to one of said retention members;

mounting the other of said retention members on said carriage and mounting said retention members for rotation about a common axis at said recording station for rotatably mounting said supply roll at said recording station;

providing a locking member;

rendering said locking member movable along with said carriage and said carriage movable relative to said locking member;

placing said retention members against opposite ends of said supply roll by moving the carriage and the locking member toward said one retention member;

arresting said locking member against movement away from said one retention member;

moving said carriage and said other retention member toward said one retention member after said arrestation of the locking member, until said retention member comes to a stop against said one tubular object;

resiliently biasing one of said retention members against said supply roll and said supply roll against the other retention member by compressing a spring against said locking member;

running said recording medium strip from said supply roll about part of said drive roller with said information recording surface layer facing away from said drive roller at said recording station irrespective of the direction in which said recording surface layer faces on said supply roll;

rotating said drive roller at said recording station and driving said recording medium strip with said rotating drive roller from said supply roll through said recording station;

recording information on successive portions of said recording medium strip while each of said portions is located on said drive roller with its information recording surface layer facing away from said drive roller; and discharging said recording medium strip from said recording station.

64. In a method of recording information, with the aid of a recording station, a drive roller and a takeup roller, on a recording medium strip wound on a supply roll and having an information recording surface layer selectively facing inwardly and outwardly on said supply roll, the improvement comprising in combination the steps of:

providing a pair of mutually adjustable supply roll retention members;

providing a carriage movable relative to one of said retention members;

mounting the other of said retention members on said carriage and mounting said retention members for rotation about a common axis at said recording station for rotatably mounting said supply roll at said recording station;

providing a locking member;

rendering said locking member movable along with said carriage and said carriage movable relative to said locking member;

placing said retention members against opposite ends of said supply roll by moving the carriage and the locking member toward said one retention member;

arresting said locking member against movement away from said one retention member;

moving said carriage and said other retention member toward said one retention member after said arrestation of the locking member, until said retention member comes to a stop against said one tubular object;

resiliently biasing one of said retention members against said supply roll and said supply roll against the other retention member by compressing a spring against said locking member;

rotatably mounting said takeup roller at a location spaced from said drive roller;

running said recording medium strip from said supply roll about part of said drive roller to said takeup roller, with said information recording surface layer facing away from said drive roller at said recording station irrespective of the direction in which said recording surface layer faces on said supply roll;

rotating said drive roller at said recording station and said takeup roller at said spaced location and driving said recording medium strip with said rotating drive and takeup rollers from said supply roll through said recording station to said takeup roller and winding said recording medium on said takeup roller with said rotating takeup roller; and recording information on successive portions of said recording medium strip while each of said portions is located on said drive roller with its information recording surface layer facing away from said drive roller.

65. In apparatus for recording information at a recording station on a recording medium strip wound on a supply roll and having an information recording surface layer selectively facing inwardly and outwardly on said supply roll, the improvement comprising in combination:

a pair of mutually adjustable supply roll retention members;

rail means extending parallel to an axis through said retention members;

means for mounting said retention members for rotation about a common axis at said recording station for rotatably mounting said supply roll at said recording station, said mounting means including a carriage riding on said rail means and mounting one of said retention members;

means coupled to said carriage for placing said retention members against opposite ends of said supply roll;

means coupled to said placing means for locking said placed retention members against movement away from each other including locking means movable along said rail means;

means coupled to said locking means for selectively arresting said locking means relative to said rail means;

means coupled to said carriage and locking means for moving said carriage relative to said arrested locking means;

means for resiliently biasing one of said retention members against said supply roll and said supply roll against the other retention member;

a drive roller;

means for mounting said drive roller at said recording station;

means for running said recording medium strip from said supply roll about part of said drive roller with said information recording surface layer facing away from said drive roller at said recording station irrespective of the direction in which said recording surface layer faces on said supply roll;

means coupled to said drive roller for rotating said drive roller at said recording station and for driving said recording medium strip with said rotating drive roller from said supply roll through said recording station;

means for recording information on successive portions of said recording medium strip while each of said portions is located on said drive roller with its information recording surface layer facing away from said drive roller; and means for discharging said recording medium strip from said recording station.

66. In apparatus for recording information at a recording station on a recording medium strip wound on a supply roll and having an information recording surface layer selectively facing inwardly and outwardly on said supply roll, the improvement comprising in combination:

a pair of mutually adjustable supply roll retention members;

rail means extending parallel to an axis through said retention members;

means for mounting said retention members for rotation about a common axis at said recording station for rotatably mounting said supply roll at said recording station, said mounting means including a carriage riding on said rail means and mounting one of said retention members;

means coupled to said carriage for placing said retention members against opposite ends of said supply roll;

means coupled to said placing means for locking said placed retention members against movement away from each other including locking means movable along said rail means;

means coupled to said locking means for selectively arresting said locking means relative to said rail means;

means coupled to said carriage and locking means for moving said carriage relative to said arrested locking means;

means for resiliently biasing one of said retention members against said supply roll and said supply roll against the other retention member;

a drive roller;

means for mounting said drive roller at said recording station;

a takeup roller rotatably mounted at a location spaced from said drive roller;

means for running said recording medium strip from said supply roll about part of said drive roller to said takeup roller, with said information recording surface layer facing away from said drive roller at said recording station irrespective of the direction in which said recording surface layer faces on said supply roll;

means coupled to said drive roller and said takeup roller for rotating said drive roller at said recording station and said takeup roller at said spaced location and driving said recording medium strip with said rotating drive and takeup rollers from said supply roll through said recording station to said takeup roller and winding said recording medium on said takeup roller with said rotating takeup roller; and means for recording information on successive portions of said recording medium strip while each of said portions is located on said drive roller with its information recording surface layer facing away from said drive roller.

* * * * *